US008420284B2

(12) United States Patent
Ohshima et al.

(10) Patent No.: US 8,420,284 B2
(45) Date of Patent: Apr. 16, 2013

(54) ELECTROPHOTOGRAPHIC PHOTORECEPTOR, IMAGE FORMING APPARATUS AND PROCESS CARTRIDGE THEREFOR USING THE ELECTROPHOTOGRAPHIC PHOTORECEPTOR

(75) Inventors: Kohichi Ohshima, Shizuoka-ken (JP); Hidetoshi Kami, Shizuoka-ken (JP); Yukio Fujiwara, Shizuoka-ken (JP); Kazuhiro Egawa, Shizuika-ken (JP)

(73) Assignee: Ricoh Company, Ltd., Tokyo (JP)

( * ) Notice: Subject to any disclaimer, the term of this patent is extended or adjusted under 35 U.S.C. 154(b) by 591 days.

(21) Appl. No.: 12/641,704

(22) Filed: Dec. 18, 2009

(65) Prior Publication Data

US 2010/0172670 A1 Jul. 8, 2010

(30) Foreign Application Priority Data

Jan. 6, 2009 (JP) ..... 2009-000622

(51) Int. Cl.
*G03G 15/00* (2006.01)

(52) U.S. Cl.
USPC ..... 430/66; 430/56; 430/58.7; 430/67

(58) Field of Classification Search ..... 430/56, 430/58.7, 66, 67
See application file for complete search history.

(56) References Cited

U.S. PATENT DOCUMENTS

| | | | | |
|---|---|---|---|---|
| 4,804,607 | A * | 2/1989 | Atsumi | 430/67 |
| 7,551,878 | B2 | 6/2009 | Ogaki et al. | |
| 7,556,901 | B2 | 7/2009 | Anezaki et al. | |
| 2005/0266328 | A1* | 12/2005 | Yanagawa et al. | 430/66 |
| 2007/0254232 | A1 | 11/2007 | Kawahara et al. | |
| 2007/0281239 | A1 | 12/2007 | Uematsu et al. | |
| 2008/0019735 | A1 | 1/2008 | Ogaki et al. | |
| 2008/0096123 | A1 | 4/2008 | Shimada et al. | |
| 2008/0124126 | A1 | 5/2008 | Anezaki et al. | |
| 2008/0124637 | A1 | 5/2008 | Uematsu et al. | |
| 2008/0227008 | A1* | 9/2008 | Kami et al. | 430/66 |
| 2009/0170023 | A1 | 7/2009 | Shimada et al. | |

FOREIGN PATENT DOCUMENTS

| | | |
|---|---|---|
| JP | 6-82221 | 10/1994 |
| JP | 07-92697 | 4/1995 |
| JP | 2520270 | 5/1996 |
| JP | 2001-66814 | 3/2001 |
| JP | 2001-166521 | 6/2001 |
| JP | 2002-196523 | 7/2002 |
| JP | 3585197 | 8/2004 |
| JP | 2005-99688 | 4/2005 |
| JP | 3963473 | 6/2007 |
| JP | 2007-233356 | 9/2007 |
| JP | 2007-233359 | 9/2007 |

* cited by examiner

*Primary Examiner* — Mark F Huff
*Assistant Examiner* — Rashid Alam
(74) *Attorney, Agent, or Firm* — Cooper & Dunham LLP

(57) ABSTRACT

An electrophotographic photoreceptor, including an electroconductive substrate; a photosensitive layer, located overlying the electroconductive substrate; and an outermost layer comprising a convexity, wherein each of the outermost layer and the convexity includes a crosslinked body including a structural unit having a same charge transportable structure, and wherein the number of convexity having a height not less than ½×RzJIS is from 30 to 300 in a measurement length of 12 mm, wherein RzJIS is an average of ten-point mean roughness specified in JIS B0601 of 2001 and measured at least 4 random positions in an area the outermost layer is formed on, and wherein the height of the convexity is a distance from the deepest valley to a top of the convexity in the measurement length of 12 mm.

7 Claims, 8 Drawing Sheets

ELECTROPHOTOGRAPHIC PHOTORECEPTOR, IMAGE FORMING APPARATUS AND PROCESS CARTRIDGE THEREFOR USING THE ELECTROPHOTOGRAPHIC PHOTORECEPTOR

BACKGROUND OF THE INVENTION

1. Field of the Invention

The present invention relates to an electrophotographic photoreceptor having high durability and producing high-quality images for long periods, and more particularly to an electrophotographic photoreceptor having good surfaceness and cleanability. In addition, the present invention relates to an image forming apparatus and a process cartridge therefor using the photoreceptor.

2. Discussion of the Related Art

Recently, a photoreceptor having an organic photosensitive layer including an organic photoconductive material on a substrate has typically been used as an electrophotographic photoreceptor (hereinafter referred to as a "photoreceptor" or an "image bearer" as well) installed in laser printers and digital copiers. Particularly, a multi layer organic photoreceptor having individual layers including a charge generation material (CGM) and a charge transport material (CTM), respectively has mostly been used because of its cost, productivity and material design flexibility, etc.

Since the electrophotographic photoreceptors are exposed to a mechanical external force and an electrical or a chemical hazard, they have various deteriorations in electrophotographic image forming process. Particularly, the electrophotographic organic photoreceptors repeatedly used for long periods to produce full-color images which have been more produced recently are required to have durability against the deteriorations more than ever.

The photoreceptor is abraded when a toner mainly formed of a colorant and a resin, which includes a hard inorganic particulate material as an additive is used, strongly pressed to a paper including a hard fiber or a clay when transferring a toner image onto the paper, or strongly frictionized by a cleaning blade when cleaning the photoreceptor. Therefore, Japanese Patents Nos. 2520270 and 3585197 disclose using polycarbonate or polyarylate having high durability as a binder resin in an organic photoreceptor.

Various photoreceptors including protection layers on the surfaces have been suggested to improve mechanical durability thereof. A protection layer including a dispersed hard particulate metal oxide is disclosed or a crosslinked protection layer is disclosed in Japanese published unexamined application No. 2001-166521. Japanese published examined application No. 6-82221 and Japanese published unexamined application No. 2002-1966523 disclose a method of lubricating the surface of a photoreceptor to prevent the surface abrasion, and which is in practical use.

As mentioned above, the photoreceptors producing more full-color images are required to produce images having higher quality than ever. Particularly, cleanability to remove a toner remaining on a photoreceptor every time when transferring a toner image onto a transfer material is required to improve more than ever. Photoreceptors having some abrasion resistance have some cleanability, but not yet satisfactory. Photoreceptors occasionally have small scratches and cracks on the surfaces when repeatedly producing images for long periods, and a toner occasionally scrapes off from a chipped blade. Particularly when a toner scrapes off from a chipped blade, images have black stripes and quality thereof deteriorates at once. Image deterioration due to a scraped-off toner needs an urgent solution for a highly-durable photoreceptor.

The surface of a photoreceptor is mostly abraded by a cleaning blade, however, when the transferability of a toner is increased, the toner remaining on the photoreceptor decreases and a pressure to the cleaning blade decreases, which prevents the blade from being chipped. Japanese published unexamined application No. 2001-66814 discloses a method of forming concavities and convexities having a specific shape such as prism, wave, cone, pyramid and well shapes on the surface of a photoreceptor with a touch roll or a stamper to increase the releasability of a toner. In addition, it is disclosed that a particulate filler including silicon or fluorine is included in a charge transport layer to improve transferability of a toner and reduce stress to a photoreceptor. However, the photoreceptor having concavities and convexities occasionally chips the edge of a cleaning blade when the surface resistivity of the photoreceptor becomes large in repeated image formation, resulting in scraping off of a toner.

Japanese published unexamined application No. 2007-233356 has recently disclosed a method of transferring a microscopic concave and convex shape on the surface of a photoreceptor. A reproducible concave shape is formed on the outermost layer with a mold while maintaining a specific relationship among a glass transition temperature of the charge transport layer, and temperatures of the mold and the substrate. Japanese Patent No. 3963473 discloses a method of roughening the surface of a photoreceptor by irradiating the outermost layer thereof with a laser beam to form plural concavities on the outermost layer. The outermost layer may include a resistivity controlling agent, but a residue thereof caused by irradiation of the laser beam remains in the concavities and is not removed with ease, resulting in hindrance to image formation.

Japanese published unexamined application No. 2005-99688 discloses a method of forming plural specific concavities on the surface of a photoreceptor to improve cleanability thereof. The concavities have openings having a specific long axis diameter, a minor axis diameter and a depth, and are present on the outermost layer at a specific surface density to prevent scratches thereon caused by external forces given by a cleaning blade, etc. in image forming processes. However, when an additive of a developer stays in the concavities and images are repeatedly formed, small black spots occasionally appear on the images. Conventional formation of concavities by a laser or a mold on the surface of a photoreceptor exactly form microscopic holes at high density and mechanically makes the outermost layer vulnerable.

Japanese published unexamined application No. 2005-99688 discloses a photoreceptor including a specific hardening resin as a binder resin and an organic or inorganic filler at the surface. Specific examples thereof include particulate carbon, particulate fluorine resins, particulate silicone resins, diamond-shaped carbon or inorganic fillers such as silicon oxides and titanium oxides. The hardening resin has an effect of preventing the filler from being dug up because of having more abrasion resistance than conventional resin matrices. However, when the outermost layer includes many particulate materials, the outermost layer is occasionally colored, resulting in insufficient light transmittance. Further, the organic filler which is soft causes insufficient durability. The hard inorganic filler is locally a large resistance to an elastic cleaning blade when projecting from the surface and chips the blade, resulting in occasional defective cleaning. So long as the outermost layer includes a filler even though the content thereof is small, the defective cleaning cannot totally be eliminated. Namely, the filler needs improving.

Japanese published unexamined application No. 7-92697 discloses a method of exerting a same effect of a filler without the filler. After an outermost surface is formed on an organic photoreceptor, a coating liquid for forming the outermost surface is diluted and sprayed with a spray gun on the surface to form convexities and concavities having a specific curvature thereon. Reversal of the cleaning blade and chipped edge thereof are prevented, but mechanical durability of the convexities needs improving.

Because of these reasons, a need exists for an electrophotographic photoreceptor having good cleanability, and preventing its cleaning blade from vibrating, kinking and reversing, and a toner from scraping off from the cleaning blade to cause defective cleaning and the toner having scraped off from fusion-bonding to the photoreceptor due to repeated image formation.

SUMMARY OF THE INVENTION

Accordingly, an object of the present invention is to provide an electrophotographic photoreceptor having good cleanability, and preventing its cleaning blade from vibrating, kinking and reversing, and a toner from scraping off from the cleaning blade to cause defective cleaning and the toner having scraped off from fusion-bonding to the photoreceptor due to repeated image formation.

Another object of the present invention is to provide an image forming apparatus using the electrophotographic photoreceptor.

A further object of the present invention is to provide a process cartridge for image forming apparatus, using the electrophotographic photoreceptor.

To achieve such objects, the present invention contemplates the provision of an electrophotographic photoreceptor, comprising:

an electroconductive substrate;

a photosensitive layer, located overlying the electroconductive substrate; and an outermost layer including a convexity, located overlying the photosensitive layer, wherein the outermost layer and the convexity include a crosslinked body including a structural unit having a same charge transportable structure, and wherein the number of convexity having a height not less than ½×RzJIS is from 30 to 300 in a measurement length of 12 mm, wherein RzJIS is an average of ten-point mean roughness specified in JIS B0601 of 2001 and measured at least 4 random positions in an area the outermost layer is formed on, and wherein the height of the convexity is a distance from the deepest valley to a top of the convexity in the measurement length of 12 mm.

These and other objects, features and advantages of the present invention will become apparent upon consideration of the following description of the preferred embodiments of the present invention taken in conjunction with the accompanying drawings.

DESCRIPTION OF THE PREFERRED EMBODIMENTS

Figure 1:
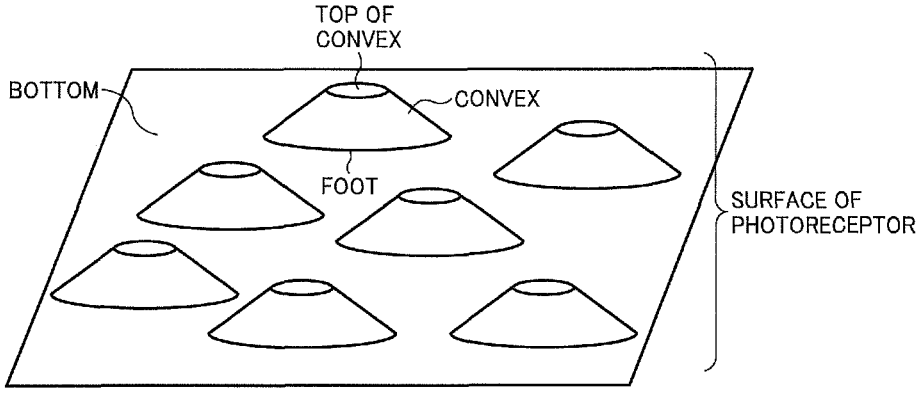
FIG. 1 is a conceptual diagram illustrating a photoreceptor having convexities on the surface of a photosensitive layer.

Generally, the present invention provides an electrophotographic photoreceptor including an outermost layer having a rough surface with highly durable and suitable convexities. Namely, the electrophotographic photoreceptor of the present invention has the specific number of crosslinked and controlled convexities having a specific height on a crosslinked outermost layer thereof, and has the following effects:

(1) sliding the blade well, and preventing the blade from vibrating, kinking and reversing;

(2) preventing a toner from scraping off and fusion-bonding; and (3) having good transferability of a toner.

More particularly, the present invention relates to an electrophotographic photoreceptor, comprising:

an electroconductive substrate;

a photosensitive layer, located overlying the electroconductive substrate; and an outermost layer including a convexity, located overlying the photosensitive layer, wherein each of the outermost layer and the convexity includes a crosslinked body including a structural unit having a same charge transportable structure, and wherein the number of convexity having a height not less than ½×RzJIS is from 30 to 300 in a measurement length of 12 mm, wherein RzJIS is an average of ten-point mean roughness specified in JIS B0601 of 2001 and measured at least 4 random positions in an area the outermost layer is formed on, and wherein the height of the convexity is a distance from the deepest valley to a top of the convexity in the measurement length of 12 mm.

Conventionally, the surface roughness of a photoreceptor such as ten-point mean roughness (Rz) and Arithmetical Mean Deviation of the Profile (Ra) has been used for discussing the cleanability of the photoreceptor. However, the present inventors discover that the cleanability of a photoreceptor cannot be well expressed only by such surface roughness, and the cleanability depends on the conditions of convexities located on the surface of the photoreceptor.

In JIS B0601 (2001), the ten-point mean roughness Rz is defined as the difference between the mean value of altitude of from the highest peak to the $5^{th}$ peak and the mean value of altitude of from the deepest valley to the $5^{th}$ valley. In the present invention, the value of altitude (height) of convexities (i.e., a distance from the deepest valley to a top of the convexity in the measurement length of 12 mm) is discussed.

Specifically, the ten-point mean roughness Rz is obtained from a profile of a surface determined by a surface roughness tester and a phase compensation band pass filter having cut-off values of λc and λs. The ten-point mean roughness Rz is represented by the following equation:

$$Rz=\tfrac{1}{5}\Sigma(Zpi+Zvj);\ (i,j=1-5)$$

wherein Zpi represents the distance (altitude) between the top of the i-th peak and the mean line of the profile curve and Zvj represents the distance between the bottom of the j-th valley and the mean line.

Thus, the higher five peaks and deeper five valleys among the peaks and valleys in the profile are used for determining the ten-point mean roughness Rz of the surface. However, there are various cases where the highest peak is or is not adjacent to the deepest valley; and peaks are or are not apart from valleys. Thus, even when the ten-point mean roughness Rz of two surfaces is the same, the conditions of the surfaces are not necessarily the same. In addition, the profile has many peaks and valleys which are not considered when determining the roughness Rz, and therefore the conditions of the surface cannot be well expressed by such roughness.

FIG. 1 is a schematic view illustrating independent convexities formed on the outermost layer of an example of the photoreceptor for use in the image forming apparatus of the present invention. In the present invention, the convexities are defined as convexities having a height not lower than ½ of the ten-point mean roughness (Rz) included in the predetermined scanning length (i.e., 12 mm). The convexities play a significant role in the cleanability of the photoreceptor. It is preferable that the convexities are independent from each other and the summit thereof is flat as illustrated in FIG. 1. In addition, it is preferable that the convexities are polished or have a smooth surface. Further, the base of the convexities is preferably smooth (i.e., the convexities are gently sloped). As illustrated in FIG. 1, a ground (groove) may be present around the convexities to separate the convexities from each other.

The height of a convexity is a distance from the deepest valley to a top of the convexity in the measurement length of 12 mm and an average thereof measured at least 4 random positions in an area the outermost layer is formed on.

In a profile, there is a case where a peak in the profile is recorded by scanning a portion of a convexity other than the summit thereof. However, when the number of convexities is counted, the number of all peaks is counted because even if the scanned portion is not the summit, the summit is considered to be present near the scanned portion.

In the present invention, the number of convexities having a height of not less than Rz/2 is counted. This is because the number of convexities can be better estimated by this method than the method in which the number of peaks having a height of not lower than Rz is counted.

Since the outermost layer of a photoreceptor is typically waved, it is preferable that the height of convexities includes the waviness (displacement) of the outermost layer. Specifically, the height of peaks is determined on the basis of the deepest valley in the profile in the scanning length of 12 mm.

Figure 2:
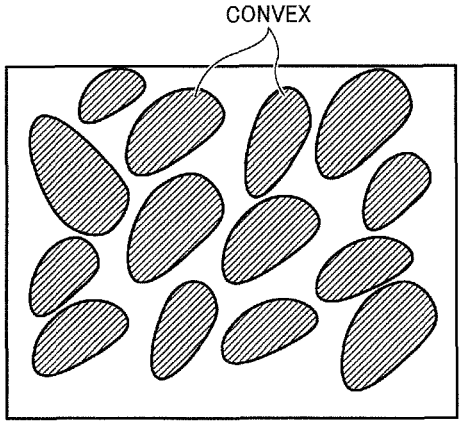
FIG. 2 is a plain view of the surface of a photoreceptor, on which amorphous convexities are randomly located.

FIG. 2 shows randomly-located convexities. A measurement direction can randomly be taken on the image forming surface of a photoreceptor. The measurement direction of a cylindrical photoreceptor may be any of a circumferential direction, an axial direction or a direction therebetween, and is conveniently the axial direction due to the measurement stand of a roughness measurer. A cylindrical multilayer photoreceptor including a charge transport layer at the surface was spray-coated under varying conditions to have a surface having different convexities. Four points on the surface of the photoreceptor in the axial direction were measured to find they were all similar profile curves. RzJIS varied less. The results are shown in Examples.

This experiment did not bring singular measurement results such that only the valleys are detected or only the summits of convexities are detected. Therefore, the average number of convexities determined from the profile curve of a photoreceptor is considered to represent the number of real convexities randomly arranged on the surface of the photoreceptor.

In this application, convexities are defined as convexities having a height of not lower than Rz/2 in a profile curve obtained by scanning the surface of a photoreceptor with a surface roughness tester. The method for forming convexities on a photoreceptor is not particularly limited. For, example, the below-mentioned methods, and known methods can be used. The methods are broadly classified into (1) methods in which a convexity forming liquid is misted to adhere the droplets to the surface of a photoreceptor; and (2) methods in which the outermost layer of a photoreceptor is partially destroyed by applying a mechanical or thermal energy thereto.

Specific examples of the methods (1) include spray coating methods, inkjet coating methods, and printing methods. Specific examples of the methods (2) include molding methods using a female die, and laser abrasion methods in which grooves are formed around a (projected) portion using a mask. Both of the methods (1) and (2) can be used for the present invention, but the methods (1) are preferably used because of hardly causing distortion in the photoreceptor. Namely, the methods (2) are inferior to the methods (1) because the outermost layer is partially destroyed. When distortion is caused, thermal annealing may be performed on the distorted photoreceptor.

Figure 3:
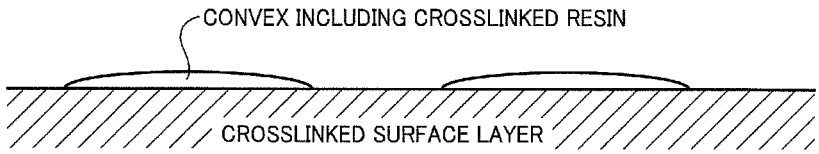
FIG. 3 is a conceptual diagram illustrating a crosslinked convexity on a crosslinked outermost layer.

The present inventors confirmed that convexities formed by a spray coating method have a bell shape (namely, a shape like parabola) when the convexities are observed with a laser microscope in a vertical/horizontal magnification ratio of 50/1. Thus, spray coating methods are considered to form convexities having a specific form. FIG. 3 is a schematic view illustrating convexities formed by a spray coating method, wherein the convexities are illustrated in a horizontal/vertical magnification ratio of about 1/1.

The surface, on which independent convexities are formed, for use in the present invention is different from a surface disclosed in a background art Japanese published unexamined application No. 2007-233359, on which a number of minor concavities are formed, or another surface disclosed in the background art and having well-form concavities and convexities.

The photoreceptor for use in the present invention has the following advantages. Specifically, since a cleaning blade, which is made of an elastic material, is contacted with the summits of a number of convexities formed on the surface of the photoreceptor, the blade can be smoothly slid because of being supported by the number of convexities. In addition, grooves are connected with each other (i.e., the convexities are substantially independent of each other), foreign materials present on the surface can be easily removed therefrom. In addition, even when one of the convexities is destroyed, the other convexities are hardly damaged because the convexities are substantially independent of each other. Further, a surface having convexities including an inorganic filler tends to chip the tip of a cleaning blade because the inorganic filler has a high hardness and strongly resists the moving blade. Therefore, it is preferable that the convexities do not include a hard inorganic filler. The surface having such convexities for use in the present invention can solve the problems mentioned above better than conventional surfaces having a number of concavities thereon.

When an elastic blade contacts the convexity shown in FIG. 3, the contact point of the blade is deformed due to elasticity and thought to contact the surface of a photoreceptor closer than thought even when the surface thereof has convexities and concavities or a wave having a large cycle. In this case, an influence of the surface roughness (except for wave curve) is thought to be explained by Rz. However, when the image forming speed increases and the blade has high hardness, the contact state between the blade the surface of a photoreceptor changes, and therefore both of the wave curve and the convexities need to be considered at the same time. The dynamic operation of the elastic blade relative to the image forming speed is not clarified yet, but as the present invention, it is thought that the number of many convexities having a height not less than Rz/2 is effectively specified to improve cleanability.

FIG. 2 is a conceptual example of the convexities of the present invention and locations thereof, but is not limited thereto.

FIG. 2 is a schematic cross section (plan view) of the convexities of an example of the photoreceptor for use in the image forming apparatus of the present invention, wherein the convexities are cut at a plane having a height of Rz/2 from the surface of the outermost layer. Therefore, the outline of a portion illustrated by the slanted lines in FIG. 2 is not the line of the base of the convexity. The shape of cross sections (illustrated by slanted lines) of the convexities is not particularly limited. In addition, the convexities may be regularly arranged or randomly arranged.

In the present invention, it is possible to count the number of convexities present in a predetermined unit area to determine the density of the convexities in the unit area. The unit area is determined depending on the size and shape of the convexities, and is generally from 100 μm×100 μm square to 15 mm×15 mm square. When a spray coating is used for forming convexities, the unit area is preferably from 1 mm×1 mm square to 15 mm×15 mm square. However, only limited instruments can be used for determining the density of the convexities in a unit area, and in addition exclusive software is needed for determining the density of the convexities. Namely, the density cannot be easily determined. Therefore, in the present application, a surface roughness tester, which is easily available, is used for obtaining the profile of the outermost layer of a photoreceptor. Specifically, a scanning operation in a scanning length of 12 mm is repeated at least 4 times to determine the average number of convexities having a height of not lower than RzJIS/2 present in a length of 12 mm of the profile. By using this method, the reliability of the measurements can be enhanced.

Next, the method for measuring the number of convexities will be explained. At first, the surface roughness Rz (i.e., ten-point mean roughness) of the surface of the outermost layer of a photoreceptor is measured by the method defined in JIS B0601 (2001). In this application, a surface texture measuring instrument SURFCOM 1400D with a measuring head DT43801 (from Tokyo Seimitsu Co., Ltd.) is used as the surface roughness tester, but the surface roughness tester is not limited thereto. The surface of the photoreceptor is scanned with the instrument to obtain the profile of the surface. Next, the number of convexities having a height of not lower than Rz/2 in a predetermined length (12 mm in this application) of the thus obtained profile curve (such as the curve illustrated in FIG. 13A) is counted to determine the density of convexities. In this application, our own program is used for automatically measuring the height of convexities in a profile curve, which is constituted of digital data. In this regard, waviness is added to the profile curve to prepare a roughness curve (such as the curve illustrated in FIG. 13B) and the number of convexities having a height of not lower than Rz/2 in the predetermined length of the thus obtained roughness curve is counted. In this regard, the digital data of the roughness curve include data of about 30,000 points, but the data is thinned out to reduce the data size to ⅕. Thus, data of 7,680 points are obtained. Next, the thus obtained curve is analyzed to check the change in height of the curve. In this regard, it is defined that a convexity is present at a peak having a height change of not lower than 40%. By using this method, the number of particularly high convexities can be counted. The present inventors discover that whether or not a photoreceptor causes the above-mentioned toner passing problem can be well determined on the basis of the number of convexities present on the surface of the photoreceptor, which have a height of not lower than Rz/2. Although digital data are thinned out to cause a peak detection error, 4 or more points are measured to assure reliability as above.

The measurement length is 12 mm in the present invention. When a spray coating method is used for forming convexities, the measurement length is generally from 1 mm to 15 mm. In this application, when a spray coating method is used for forming convexities, the number of convexities in the measurement length of 12 mm is preferably from 30 to 300, and more preferably from 30 to 100.

In the present invention, the outermost layer of a photoreceptor and convexities formed thereon include a crosslinked body including a structural unit having a same charge transportable structure. The crosslinked structure of the crosslinked body increase hardening density and has high hardness and high elasticity, and therefore the resultant photoreceptor has high durability and produces high-quality images. Accordingly, the surface of the photoreceptor has good resistance to cleaning blades. It is preferable that the convexities have a crosslinking density so as not to be dissolved in solvents such as tetrahydrofuran and toluene and a resistance to frictional force of cleaning blades.

Cleaning blades are typically made of an elastic material such as hard rubbers (e.g., polyurethane rubbers) and have a plate form. For example, when such a cleaning blade is contacted with the surface of the photoreceptor so as to counter the rotated photoreceptor, toner particles remaining on the surface of the photoreceptor are scraped off by the cleaning blade. In this case, it is considered that the tip portion of the cleaning blade causes microscopic vibrations (i.e., sticking and slipping of the tip portion) due to friction with the surface of the photoreceptor, and it is preferable that the cleaning blade stably causes such microscopic vibrations. In this regard, the conditions of the vibrations change depending on the properties of the cleaning blade and the surface of the photoreceptor. It is considered that by contacting a cleaning blade with the surface of the photoreceptor having such convexities as mentioned above, such microscopic vibrations can be stably caused. Namely, cleaning blades can stably slide on the surface of the photoreceptor having such convexities as mentioned above over a long period of time.

The convexities on the photoreceptor can be observed with an instrument such as laser microscopes, optical microscopes, electron microscopes, and atom force microscopes. Specific examples of the laser microscopes include a 3D profile microscope VK-8550 from Keyence Corporation, SURFACE EXPLORER SX-520DR from Ryoka Systems Inc., and a confocal laser scanning microscope OLS3000 from Olympus Corporation. Specific examples of the optical microscopes include a digital microscope VHX-500 from Keyence Corporation, and 3D digital microscope VC-7700 from Omron Corporation. Specific examples of the electron microscopes include a 3D real surface view microscope VE-9800 from Keyence Corporation, and a scanning electron microscope SUPERSCAN SS-550 from Shimadzu Corporation. Specific examples of the atom force microscopes include a scanning probe microscope SPM-9600 from Shimadzu Corporation. By using such microscopes, conditions of the convexities such as shape of the convexities and the summit thereof, conditions of the bases of the convexities, arrangement of the convexities, and height of the convexities can be determined.

The method for forming convexities on the surface of the photoreceptor is not particularly limited, and any methods can be used as long as the above-mentioned requirements for the convexities can be satisfied.

Specific examples thereof include (1) a spray coating method spraying a coating liquid including constituents forming convexities on the surface of an electrophotographic photoreceptor with a spray gun to form convexities thereon; (2) a printing method printing a coating liquid including constituents forming convexities on the surface of a photoreceptor with an engraved plate, a flat plate, a hole plate or a relief printing plate; and (3) an inkjet method forming convexities with an inkjet.

The above-mentioned methods are explained.

(1) Spray Coating Method

Figure 4:
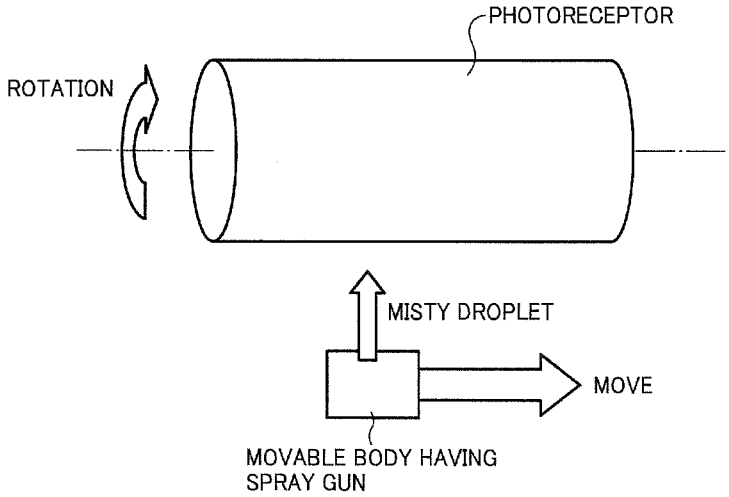
FIG. 4 is a conceptual diagram illustrating a spray coater for forming convexities.

Any known spray coating methods can be used for forming convexities. FIG. 4 illustrates a spray coating device.

At first, the photoreceptor is rotated by a driving device (not shown) at a predetermined speed. Next, a coating liquid and a gas are supplied to a spray gun while moving (oscillating) the spray gun in the direction parallel to the axis of the photoreceptor to spray mists of the coating liquid to the surface of the photoreceptor, resulting in formation of coated films (i.e., convexities). The conditions of the convexities depend on the coating conditions such as viscosity of the coating liquid, concentration of the solvent included in the coating liquid, rotation speed of the photoreceptor, oscillating speed of the spray gun, shape of the nozzle of the spray gun, and pressure and flow rate of the supplied gas.

(2) Relief and Engraved Printing Methods

Known methods can be used to form the convexities of the present invention. Particularly, the engraved plate printing method is preferably used because a coating liquid for forming convexities is quantitatively transferred. The hole plate printing method is also preferably used in the second place because a coating liquid for forming convexities filled in the hole plate is scraped by a squeegee when too much and quantitatively transferred. The plates can be prepared by known methods. For example, concavities are formed on a plastic film is formed by a semiconductor laser to prepare a plate.

(3) Inkjet Method

Known methods can be used to form the convexities with an inkjet. The inkjet method basically replaces the spray gun in (1) with a head for inkjet. A photoreceptor drum is rotated at a predetermined speed by a rotation driver. Next, an inkjet head fitted on a moving coating body is oscillated in an axial direction of the photoreceptor drum while a coating liquid for forming convexities is fed thereto to emit a particulate droplet of the coating liquid toward the photoreceptor drum and form plural convexities having a desired location and a skirt on the surface thereof. Basic forming conditions include a quantity, a viscosity and a concentration of the particulate droplet of the coating liquid in a solvent; a rotation number and an oscillate speed of the photoreceptor; the shape of a discharge opening of the head; etc. These can properly be selected. The particulate droplet is preferably generated by piezo methods to be emitted.

The photoreceptor of the present invention includes at least a substrate and an organic photosensitive layer (hereinafter referred to as a "photosensitive layer") formed on the substrate. The convexities may be formed on the photosensitive layer, and in this case, the photosensitive layer and the convexities formed thereon include a crosslinked body including a structural unit having a same charge transportable structure. When an outermost layer is further formed on the photosensitive layer to protect the surface thereof, the convexities may be formed on the outermost layer, and in this case, the outermost layer and the convexities formed thereon include a crosslinked body including a structural unit having a same charge transportable structure.

The photosensitive layer is not particularly limited, and is a single-layer photosensitive layer including both a charge generation material and a charge transport material, or a functionally separated multilayer photosensitive layer in which a charge generation layer and a charge transport layer are overlaid. However, a photoreceptor having a functionally separated multilayer photosensitive layer is preferably used for the image forming apparatus of the present invention. In this regard, the positions of the charge generation layer and the charge transport layer are not particularly limited, and both a normal multilayer photosensitive layer in which a charge transport layer is formed on a charge generation layer and a reverse multilayer photosensitive layer in which a charge generation layer is formed on a charge transport layer can be used.

Figure 5:
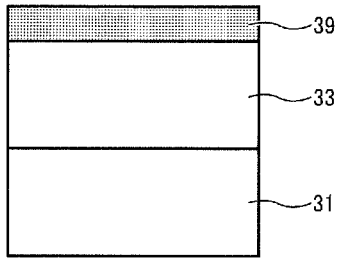
FIG. 5 is a schematic view illustrating an embodiment of the layer constitution of the photoreceptor of the present invention.
Figure 6:
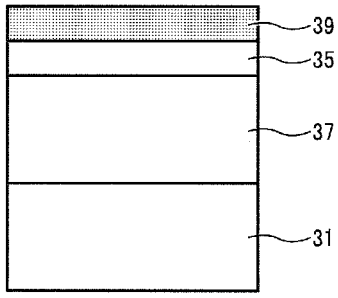
FIG. 6 is a schematic view illustrating another embodiment of the layer constitution of the photoreceptor of the present invention.
Figure 7:
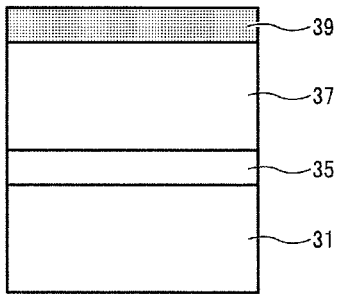
FIG. 7 is a schematic view illustrating a further embodiment of the layer constitution of the photoreceptor of the present invention.

FIGS. 5-7 illustrate layer structures of photoreceptors for use in the image forming apparatus of the present invention.

The photoreceptor illustrated in FIG. 5 includes a substrate 31, a single-layered photosensitive layer 33 located on the substrate, and an outermost layer 39 located on the photosensitive layer.

Any known electroconductive materials can be used for the substrate 31. For example, substrates of metals such as iron, copper, gold, silver, aluminum, zinc, titanium, lead, nickel, tin, antimony, indium, chromium, aluminum alloys, and stainless steel can be used. In addition, metal substrates and plastic substrates, on which a layer of aluminum, aluminum alloy, or indium oxide-tin oxide is formed using a vacuum evaporation method can also be used. Further, substrates such as plastics and papers, in which particles of an electroconductive material such as carbon blacks, tin oxide, titanium oxide and silver are dispersed optionally together with a binder resin can also be used. Furthermore, plastic substrates including an electroconductive resin can also be used.

The surface of the substrate may be subjected to a treatment such as cutting treatments, roughening treatments, and alumite treatments to prevent formation of interference fringes (i.e., moiré) when a light irradiating process is performed using a laser beam.

An undercoat layer can be formed between the substrate and the photosensitive layer to prevent formation of interference fringes (i.e., moiré) and to cover up flaws of the substrate.

The undercoat layer is typically prepared by applying an electroconductive layer coating liquid including a binder resin and a carbon black, or a particulate material or a pigment, which has a proper electroconductivity. The coating liquid may include a crosslinkable compound. Further, the surface of the undercoat layer may be roughened. The thickness of the undercoat layer is preferably from 0.2 to 20 μm, and more preferably from 5 to 10 μm.

Specific examples of the binder resin for use in the undercoat layer include known resins such as polymers and copolymers of vinyl compounds (e.g., styrene, vinyl acetate, vinyl chloride, acrylate, methacrylate, vinylidene fluoride, and trifluoroethylene), polyvinyl alcohol, polyvinyl acetal, polycarbonate, polyester, polysulfone, polyphenylene oxide, polyurethane, cellulose resins, phenolic resins, melamine resins, silicone resins, and epoxy resins.

Specific examples of the electroconductive particles and pigments include particles of metals and metal alloys such as aluminum, zinc, copper, chromium, nickel, silver and stainless steel, and particulate plastics on which a layer of one or more of the above-mentioned metals and metal alloys is formed by a vacuum evaporation method. In addition, metal oxides such as zinc oxide, titanium oxide, tin oxide, antimony oxide, indium oxide, bismuth oxide, indium oxide doped with tin, and tin oxide doped with antimony or tantalum can also be used. These materials can be used alone or in combination. When two or more of the materials are used in combination, mixtures thereof, solid dispersions thereof and materials in which the materials are fused together can be used.

A blocking layer (i.e., a charge injection preventing layer), which has a barrier function and/or an adhesive function, can be formed between the substrate and the undercoat layer. Namely, the blocking layer is formed to reduce charge injection from the substrate and to prevent the photosensitive layer from electrically damaging.

Specific examples of the materials for use in the blocking layer include polyvinyl alcohol, poly-N-vinyl imidazole, polyethylene oxide, ethyl cellulose, ethylene-acrylic acid copolymers, casein, polyamide, N-methoxymethylated 6-nylon, nylon copolymers, etc. The blocking layer is typically prepared by applying a coating liquid which is prepared by dissolving one or more of these materials in a solvent, and then drying the coated liquid.

The thickness of the blocking layer is preferably from 0.05 to 7 μm, and more preferably from 0.1 to 2 μm.

Next, the photosensitive layer will be explained. The photosensitive layer includes a charge generation material. Specific examples of the charge generation materials include pyrylium dyes, thiopyrylium dyes, phthalocyanine pigments having crystal forms such as α-form, β-form, γ-form, and ε-form and including for which various metals can be used, anthanthrone pigments, dibenzpyrenequinone pigments, pyranthrone pigments, azo pigments such as monoazo, disazo and trisazo pigments, indigo pigments, quinacridone pigments, asymmetric quinocyanine pigments, quinocyanine pigments, amorphous silicone, etc. These charge generation materials can be used alone or in combination.

The photosensitive layer further includes a charge transport material. Specific examples of the charge transport materials include pyrene compounds, N-alkylcarbazole compounds, hydrazone compounds, N,N-dialkylaniline compounds, diphenylamine compounds, triphenylamine compounds, triphenyl methane compounds, pyrazoline compounds, styryl compounds, stilbene compounds, etc.

In the case of a multilayer photosensitive layer including a charge generation layer and a charge transport layer, the charge generation layer is typically prepared by the following method. Specifically, a charge generation material, a binder resin, whose weight is 0.3 to 4 times the weight of the charge generation material, and a solvent are mixed, and the mixture is subjected to a dispersion treatment using a dispersing device such as homogenizers, ultrasonic dispersing devices, ball mills, vibration mills, sand mills, attritors, and roll mills. The thus prepared dispersion is applied, followed by drying, resulting in formation of a charge generation layer. Alternatively, a charge generation layer may be formed by an evaporation method.

The charge transport layer is typically prepared by applying a coating liquid which is prepared by dissolving a charge transport material and a binder resin in a solvent, and then drying the coated liquid. In this regard, when a charge transport material having good film formability is used, the coating liquid may be prepared by dissolving only the charge transport material in a solvent without using a binder resin.

Specific examples of the materials for use as the binder resin include polymers and copolymers of vinyl compounds (such as styrene, vinyl acetate, vinyl chloride, acrylate, methacrylate, vinylidene fluoride, and trifluoroethylene), polyvinyl alcohol, polyvinyl acetal, polycarbonate, polyester, polysulfone, polyphenylene oxide, polyurethane, cellulose resins, phenolic resins, melamine resins, silicone resins, and epoxy resins.

The thickness of the charge generation layer is preferably not greater than 5 μm, and more preferably from 0.1 to 2 μm.

The thickness of the charge transport layer is preferably from 5 to 50 μm, and more preferably from 10 to 35 μm.

In the photoreceptor of the present invention, the crosslinked outermost layer and the crosslinked convexities preferably have continuity (such as electric continuity and mechanical continuity), i.e., the crosslinked convexities are preferably integrated with the outermost layer. In order that the crosslinked outermost layer and the crosslinked convexities have electric continuity and mechanical continuity, they preferably have continuity in formulation. Specifically, it is preferable that the crosslinked outermost layer and the crosslinked convexities include the same crosslinked charge transport material at the same content. For example, when the crosslinked outermost layer includes a crosslinked material having the triarylamine structure (1) mentioned above, the crosslinked convexities preferably include the crosslinked material at the same content.

When the charge transport material used for the convexities is different from that included in the outermost layer, the charge carriers tend to have energy gap, thereby causing electric deficiency. The difference in content of the charge transport material between the outermost layer and the convexities is preferably within 10% by mole. When the difference in content is greater than the range, it is not preferable in view of charge transporting, i.e., the residual potential of the photoreceptor increases. In addition, the method for crosslinking the outermost layer is preferably the same as the method for crosslinking the convexities so that the outermost layer and the convexities have continuity in physical properties.

In a conventional photoreceptor in which a coating liquid of an outermost layer having no crosslinking ability is applied on a layer which is not crosslinked, the charge transport material included therein is migrated in the drying process (because the lower layer is partially dissolved in the solvent included in the coating liquid), and thereby the layers have continuity. However, when a coating liquid is applied on a crosslinked outermost layer, which is hardly dissolved in the solvent), it is difficult for the layers to have continuity. Therefore, it is important for the photoreceptor for use in the present invention that the convexities and the outermost layer thereof have continuity to produce the effects of the present invention.

Formation of convexities is strongly influenced by the wettability of the crosslinked outermost layer. Specifically, when a coating liquid for forming convexities is misted by a spray coating method to be applied on an outermost layer, which is not crosslinked, droplets on the surface of the outermost layer are mixed with the outermost layer, and thereby such convexities as mentioned above for use in the present invention cannot be formed. Particularly, when the reactive monomer included in the coating liquid is liquid at room temperature, the film of the coated liquid on the outermost layer is liquid even if the solvent in the coating liquid is evaporated, and thereby the film is rapidly mixed with the outermost layer. Therefore, in order to prevent occurrence of such a mixing problem in the present invention, the coating liquid for forming the convexities is preferably applied on a crosslinked outermost layer.

The coating liquid for forming the convexities preferably includes a surfactant, and more preferably a reactive surfactant. For example, reactive silicone compounds having an acryloyloxy group at both end portions of the molecule are preferably used. In addition, other reactive surfactants can also be used. The content of a surfactant included in each of the coating liquids for forming the convexities and the outermost layer is generally from 0.5 to 10% by weight based on the total weight of the solid components included in the coating liquid.

Known charge transport materials can be used for preparing an outermost layer, which can have continuity with the convexities. In addition, chain-polymerizable compounds having a group such as acryloyloxy and styrene groups, and step-reaction polymerizable compounds having a group such as hydroxyl, alkoxysilyl and isocyanate groups can be used as the polymerization or crosslinking monomer or oligomer to be included in the outermost layer coating liquid. In view of the electrophotographic properties of the photoreceptor, flexibility in selection of materials of the photoreceptor, and preparation stability of the photoreceptor, combinations of a positive hole transporting compound and a chain-polymerizable compound are preferably used for the outermost layer coating liquid. More preferably, crosslinkable compounds having both a positive hole transporting group and an acryloyloxy group in a molecule thereof are used therefor. In this case, the coated layer is crosslinked using heat, light or radiation rays. In this regard, it is preferable that the outermost layer is crosslinked three-dimensionally.

In the present invention, crosslinked convexities can be formed on a crosslinked charge transport layer. Polymerizable or crosslinkable materials include compounds having a charge transport structure and one or more (meth)acryloyloxy groups. In this regard, compounds having no charge transport structure and one or more (meth)acryloyloxy groups may be used in combination therewith. When preparing the crosslinked charge transport layer and the convexities using a coating liquid including such a compound, the coating liquid is applied (or sprayed) and then energy such as heat, light and radiation rays such as electron rays and γ rays is applied thereto to crosslink the layer or convexities.

Suitable materials for use as the compounds having a charge transport structure for use in the charge transport layer and the convexitie include compounds having a triarylamine structure. More preferably, compounds having a triarylamine structure and at least one radically polymerizable mono-functional group are used so that the compounds can be reacted with the binder resin to form a crosslinked network.

For example, charge transport materials having the following formula (1) are preferably used.

(1)

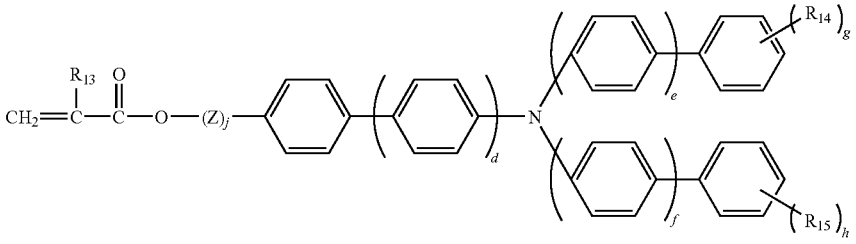

wherein each of d, e and f is 0 or 1; each of g and h is 0 or an integer of from 1 to 3; $R_{13}$ represents a hydrogen atom or a methyl group; each of $R_{14}$ and $R_{15}$ represents an alkyl group having from 1 to 6 carbon atoms, wherein when g is 2 or 3, the groups $R_{14}$ may be the same or different from each other, and when h is 2 or 3, the groups $R_{15}$ may be the same or different from each other; Z is a methylene group, an ethylene group or one of the following groups:

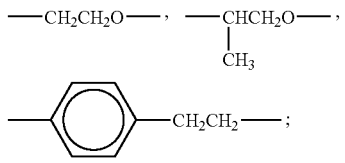

and j is 0 or 1

Specific examples of the compounds having formula (1) are as follows.
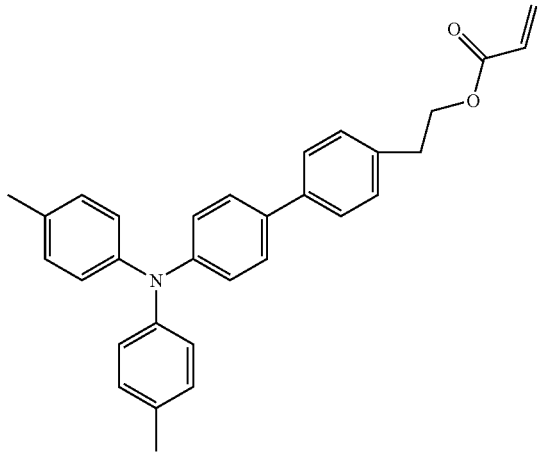
(2-[4'-(di-p-tolyl-amino)biphenyl-4-yl]ethyl acrylate)
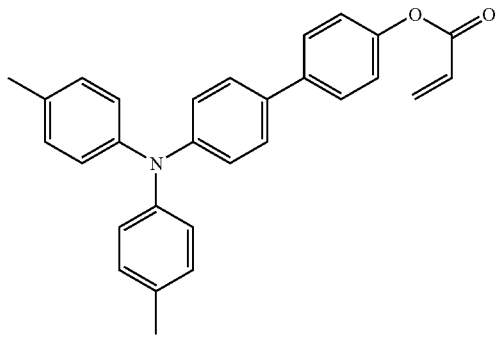
(2-[4'-(di-p-tolyl-amino)biphenyl-4-yl]acrylate)
No. 1
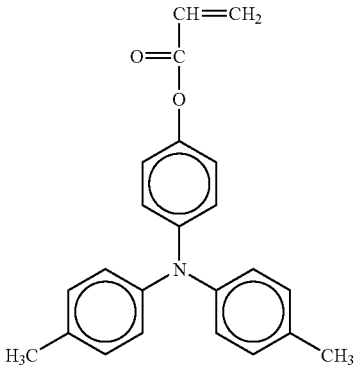
-continued
No. 2
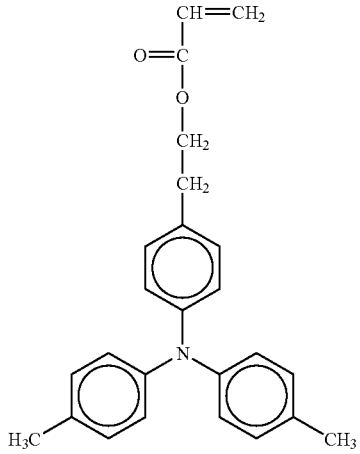
No. 3
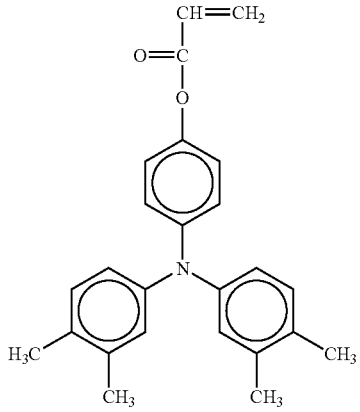
No. 4
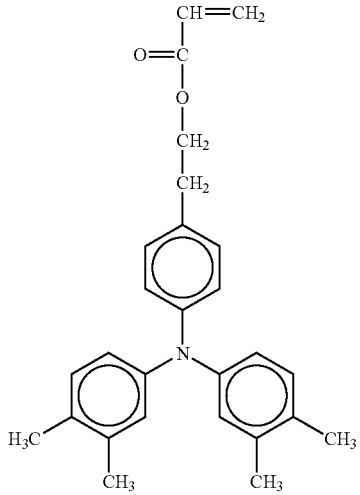

-continued
No. 5
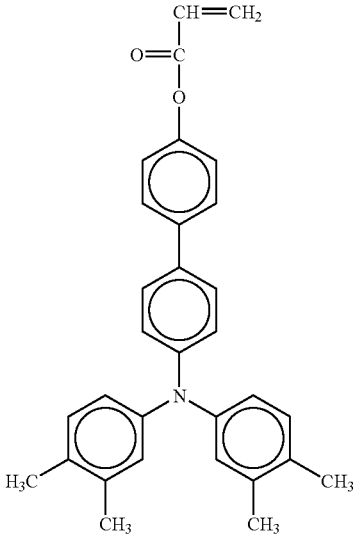
-continued
No. 7
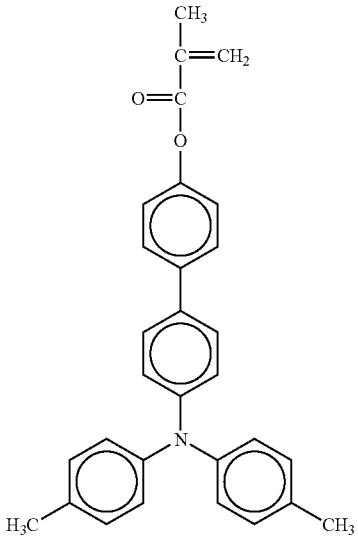
No. 6
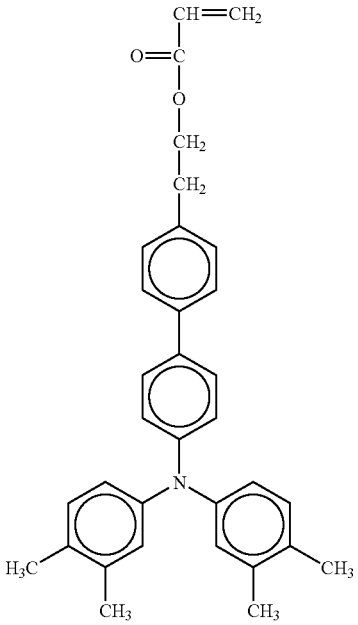
No. 8
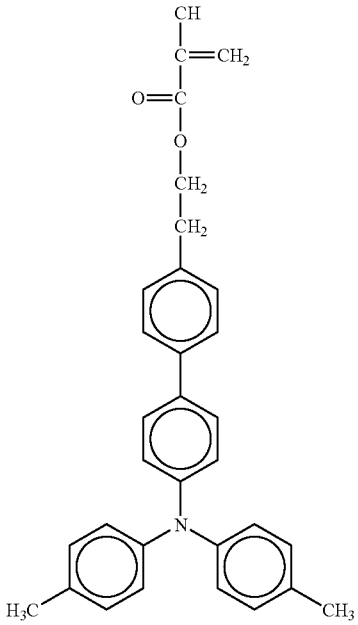

-continued
No. 9
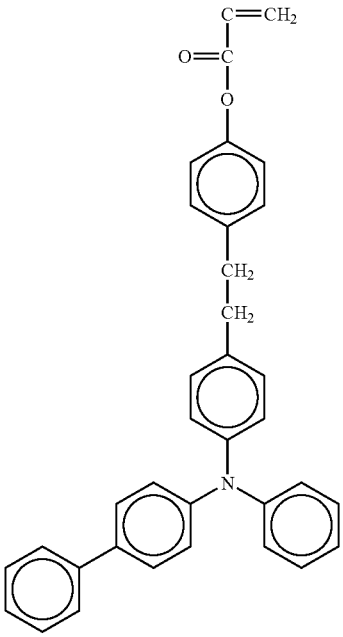
No. 10
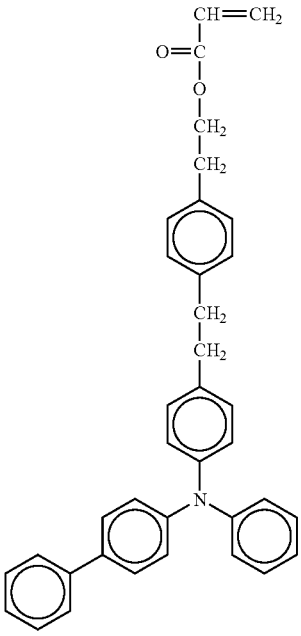
-continued
No. 11
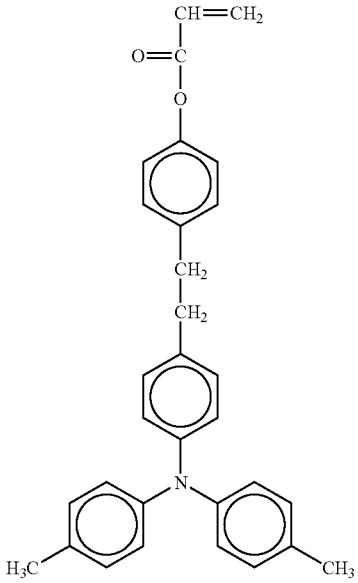
No. 12
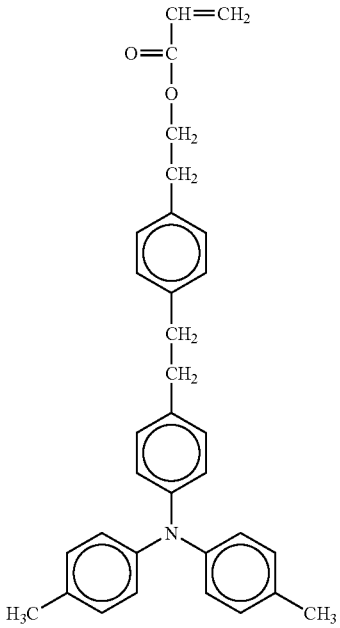

-continued
No. 13
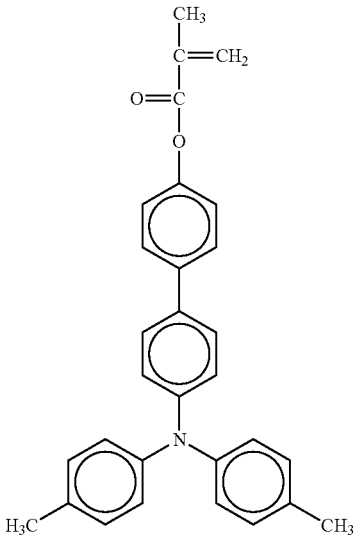
-continued
No. 15
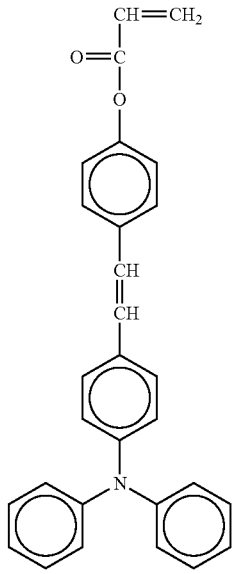
No. 14
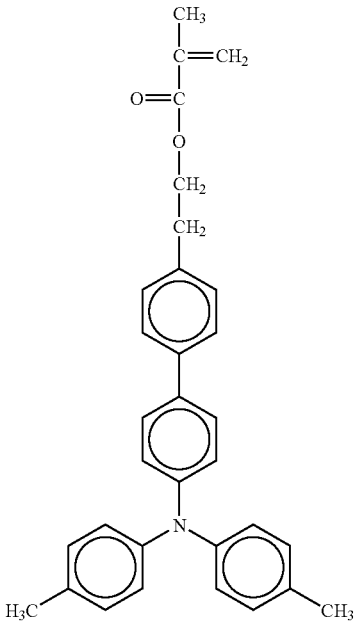
No. 16
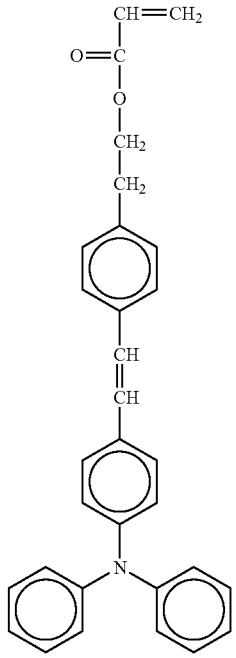

-continued
No. 17
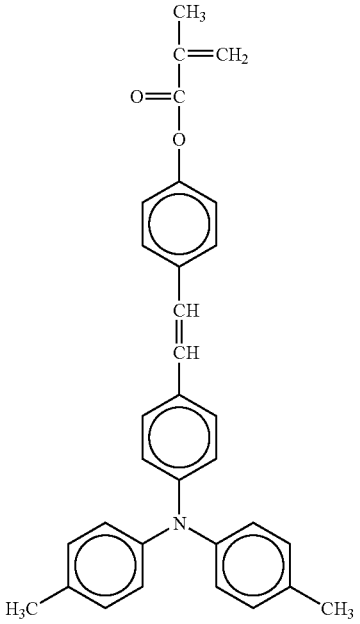
No. 18
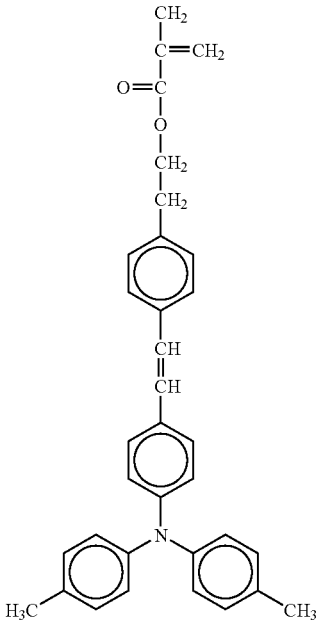
-continued
No. 19
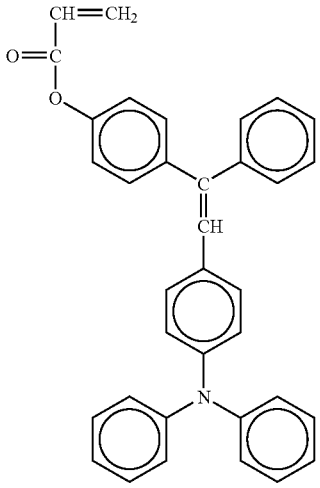
No. 20
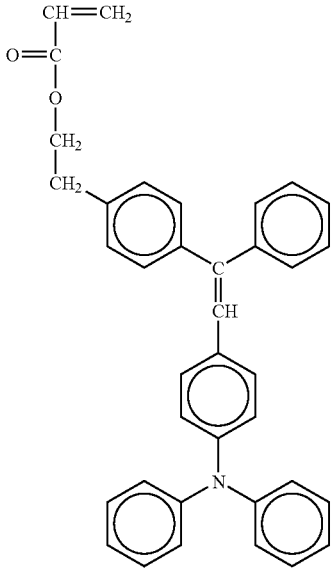
No. 21
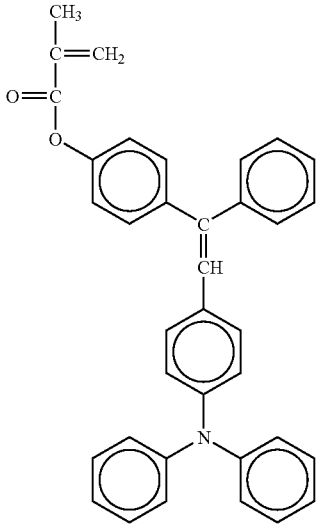

-continued
No. 22
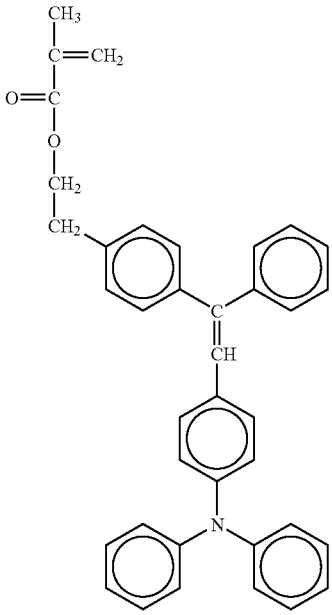
No. 23
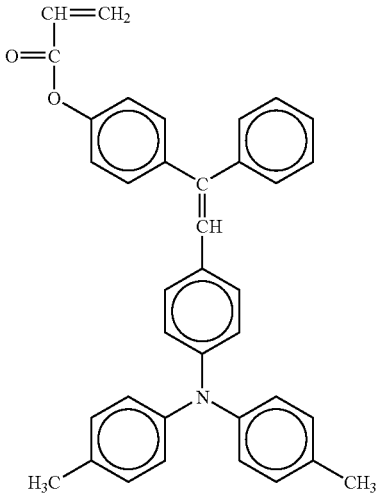
-continued
No. 24
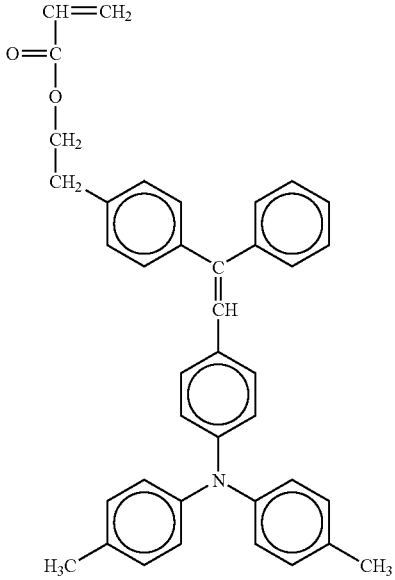
No. 25
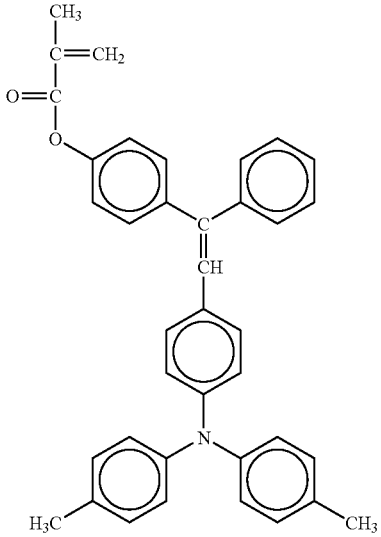

-continued

No. 26

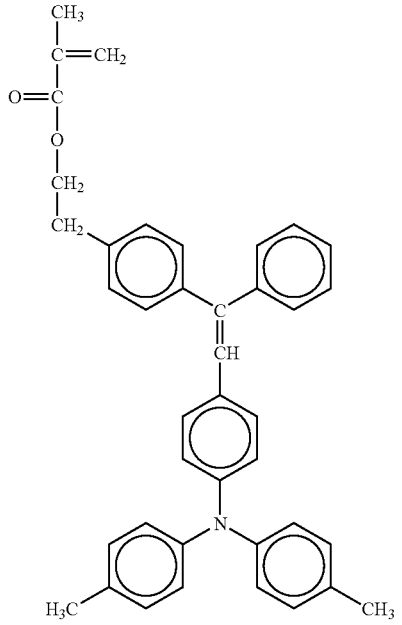

The thickness of the crosslinked resin layer (serving as a charge transport layer) is preferably from 5 to 50 μm, and more preferably from 10 to 35 μm similarly to the above-mentioned charge transport layer.

When the resin layer is a second charge transport layer or a protective layer, the thickness of the resin layer is from 0.1 to 20 μm, and more preferably from 1 to 10 μm. When a number of convexities are present on the surface of the outermost layer, the thickness of the outermost layer cannot be well determined. Therefore, it is preferable to use a thickness meter utilizing eddy current (such as FISCHER SCOPE MMS from Fischer Instruments K.K.) because the influence of the convexities on the thickness can be reduced. In this regard, the thicknesses of the outermost layer at randomly selected four points are measured with the instrument, and the thickness data are averaged to determine the thickness of the layer. The thickness of the charge generation layer was determined by converting a transmission of the charge transport layer formed under the same conditions as those of forming the charge generation layer after determining a relationship between the charge generation layer formed on a slide glass and the transmission.

As mentioned above, the photoreceptor for use in the image forming apparatus of the present invention has an outermost layer having good abrasion resistance and specific convexities located on the surface of the outermost layer. In conventional photoreceptors having good abrasion resistance, the surface of the photoreceptors is hardly abraded, namely, the surface is hardly renewed. Therefore, foreign materials such as toner particles and paper dust and contaminants such as ionized materials caused by acidic gases such as NOx tend to accumulate thereon, thereby causing problems such that the cleaning blade is not smoothly slid on the surface of the photoreceptor, and the tip of the blade is vibrated, twisted and/or reversed, resulting in deterioration of the cleanability of the blade or chipping of the tip of the blade, thereby deteriorating the image qualities. Since the photoreceptor for use in the present invention has such an improved surface as mentioned above, occurrence of the problems can be prevented.

Next, the image forming apparatus of the present invention will be explained by reference to drawings. However, the image forming apparatus of the present invention is not limited to the illustrated examples.

Figure 8:
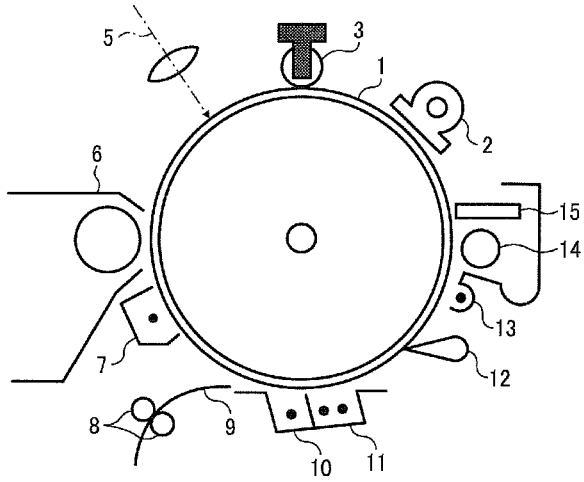
FIG. 8 is a schematic view for explaining an image forming process and an image forming apparatus of the present invention.

FIG. 8 is a schematic view for explaining the image forming apparatus of the present invention.

Referring to FIG. 8, a photoreceptor 1 is the photoreceptor mentioned above for use in the image forming apparatus of the present invention. Although the photoreceptor 1 has a drum form, photoreceptors having a sheet form or an endless belt form can also be used.

Specific examples of a charging device 3 include non-contact chargers such as corotron chargers, scorotron chargers and solid state chargers; and contact chargers such as charging rollers and charging brushed.

Figure 9:
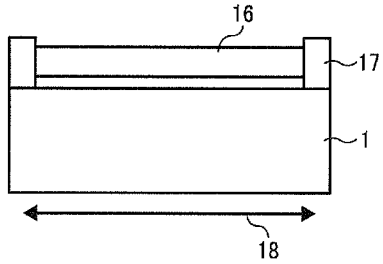
FIG. 9 is a schematic view illustrating an embodiment of the charger for use in the present invention.

In addition, short range chargers in which a charging roller 16 is opposed to the photoreceptor 1 with a small gap therebetween in an image forming area 18 as illustrated in FIG. 9 can be preferably used. When a charging roller is contacted with the surface of a photoreceptor while a lubricating material is applied to the surface, it is possible that contamination of the charging roller is accelerated by the lubricating material adhered to the charging roller. Contamination of the charging roller causes uneven charging and acceleration of contamination of the photoreceptor. By using such a short range charger as illustrated in FIG. 9, occurrence of such problems can be prevented.

The method for forming a small gap between the charging member 16 and the photoreceptor 1 is as follows:

(1) A gap forming member 17 is provided on both edge portions of the charging member 16 as illustrated in FIG. 9;

(2) A gap forming member is provided on both edge portions of the photoreceptor; and (3) A gap forming member is provided on the flanges set on both edge portions of the photoreceptor.

In the present invention, all the methods (1)-(3) can be used. The gap forming member 17 should be insulating while having good abrasion resistance. The shape of the gap forming member 17 is not particularly limited, and for example gap forming members with tape form, seal form or tube form can be used.

The gap between the surface of the charging member 16 and the surface of the photoreceptor 1 is preferably from 10 to 200 μm, more preferably from 20 to 100 μm, and even more preferably from 40 to 80 μm. When the gap is smaller than the range, a problem in that the charging member and the photoreceptor contact with each other occurs. In this case, the advantages of the short range charger cannot be obtained, and in addition the image qualities deteriorate. In contrast, when the gap is larger than the range, stability of charging deteriorates and uneven charging tends to be performed. In this regard, by using a DC voltage superimposed with an AC component, the uneven charging problem can be avoided, resulting in prevention of deterioration of the image density and the contrast of images.

Corona chargers such as corotron chargers and scorotron chargers tend to generate less discharge product adhering to the surface of a photoreceptor, but tend to generate much more ozone. In contrast, the charging roller reduces ozone, but increases discharge products. Both of the ozone and the discharge products largely cause image distortion. Since the present invention prevents the image distortion due to the discharge products, the present invention exerts its effect when using a charging roller as a charger.

Referring to FIG. 8, a light irradiating device (not shown) irradiates the charged photoreceptor 1 with an imagewise light beam 5 to form an electrostatic latent image on the surface of the photoreceptor. Specific examples of the light source of the light irradiating device include fluorescent lamps, tungsten lamps, halogen lamps, mercury lamps, light emitting diodes (LEDs), laser diodes (LDs), electroluminescence (EL) devices, etc. In order to irradiate the photoreceptor 1 with a light beam having a wavelength in a desired wavelength range, filters such as sharp cut filters, band pass filters, near infrared cut filters, dichroic filters, interference filters, color conversion filters, etc., can be used.

A developing device 6 develops the electrostatic latent image formed on the photoreceptor 1 to form a visual image on the photoreceptor. Specific examples of the developing method include dry developing methods such as one component developing methods and two component developing methods, which use a dry toner, and wet developing methods using a liquid toner.

When the photoreceptor 1 is charged positively (or negatively), followed by light irradiating, a positive (or negative) electrostatic latent image is formed on the surface of the photoreceptor. When the positive (or negative) electrostatic latent image is developed with a negative (or positive) toner, a positive image can be obtained. In contrast, when the positive (or negative) electrostatic latent image is developed with a positive (or negative) toner, a negative image can be obtained.

Figure 10:
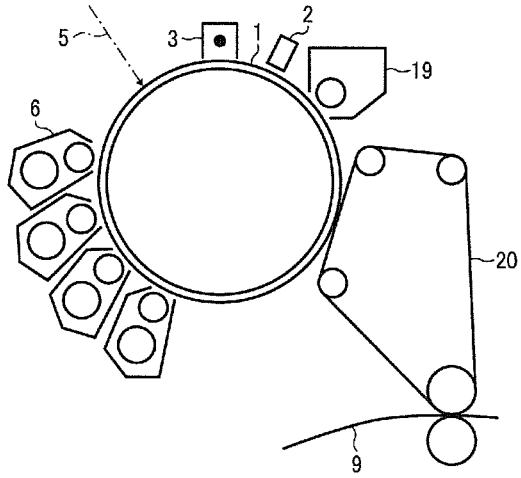
FIG. 10 is a schematic view for explaining another embodiment of the image forming process of the present invention.
Figure 11:
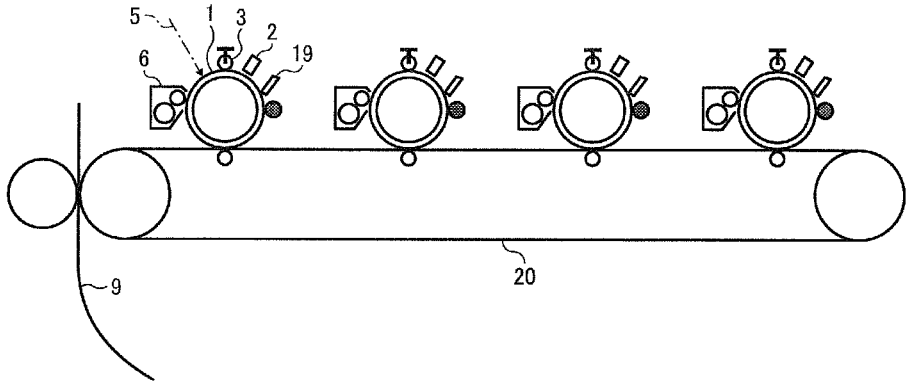
FIG. 11 is a schematic view for explaining a further embodiment of the image forming process of the present invention.

When full color images are formed, the developing device 6 includes at least a developing unit capable of forming yellow, magenta, cyan and black color images. Specific examples of the full color developing device include (1) a developing device in which four color developing units (i.e., yellow, magenta, cyan and black color developing units) are arranged around the photoreceptor 1 (as illustrated in FIG. 10); (2) a developing device having a developing unit in which four color toners are separately contained; (3) a revolver developing device in which four color developing units revolve such that one of the developing units is opposed to the photoreceptor; and (4) a tandem developing device in which four color developing units are arranged side by side so as to be opposed to the respective photoreceptors as illustrated in FIG. 11.

A toner used for the developing device 6 is not particularly limited, and any toners such as pulverization toners prepared by a pulverization method and polymerization toners prepared by a polymerization method can be used. In order to produce high quality images, polymerization toners are preferably used. It is well known that polymerization toners have spherical or approximately spherical forms. Since such toners have good releasability, the transfer rate of toner images is improved, and thereby the amount of residual toner on the surface of the photoreceptor can be reduced, resulting in prevention of formation of abnormal images such as images with background fouling. However, spherical or approximately spherical toners present on the surface of a photoreceptor cannot be well removed with a cleaning blade. Therefore, it is difficult to use spherical or approximately spherical toners for conventional image forming apparatus because the toners have such a disadvantage. Therefore, it is difficult for such conventional image forming apparatus to transfer toner images at high toner transfer efficiency.

In contrast, since specific micro convexities are formed on the surface of the photoreceptor of the image forming apparatus of the present invention, the releasability and cleanability of the photoreceptor can be dramatically improved. Specifically, by increasing the linear pressure of the cleaning blade contacted with the convexities on the photoreceptor, movement of spherical or approximately spherical toner, which can easily roll on the surface of the photoreceptor, can be prevented, and thereby toner particles remaining on the photoreceptor can be easily removed with the cleaning blade.

The thus prepared toner image on the photoreceptor 1 is transferred onto a receiving material such as paper sheets optionally via an intermediate transfer medium.

In a tandem image forming apparatus having an intermediate transfer medium 20, which is illustrated in FIG. 11, the photoreceptors 1, each of which is the photoreceptor mentioned above for use in the present invention, are contacted with the intermediate transfer medium 20. Therefore, the photoreceptors 1 are not directly contacted with a receiving material such as paper sheets. In this regard, the intermediate transfer medium 20 can have a form such as endless belt forms, sheet forms and drum forms.

The toner images transferred onto the intermediate transfer medium 20 are transferred onto a receiving material 9 (in this case, a paper sheet is used as the receiving material 9) with a transfer device. Specific examples of the transfer device include known transfer devices such as electrostatic transfer devices (e.g., transfer chargers and bias rollers); mechanical transfer devices (e.g., adhesion transfer devices and pressure transfer devices); magnetic transfer devices; etc.

When a toner image is transferred from a photoreceptor to a receiving material (or an intermediate transfer medium), a large amount of toner particles remain on the surface of the photoreceptor if the photoreceptor has low releasability, resulting in formation of abnormal images (such as omissions of center portions of images) and deterioration of image qualities due to low transfer efficiency. By forming the specific convexities on the surface of the photoreceptor as mentioned above, the releasability of the surface of the photoreceptor can be improved, and thereby the transfer efficiency can be improved while preventing formation of omissions of center portions of images (hereinafter referred to as image omissions). The intermediate transfer medium 20 is preferably used for the image forming apparatus of the present invention because the photoreceptor 1 is prevented from being contacted with paper sheets (namely, paper dust is prevented from adhering to the surface of the photoreceptor). When discharging-induced materials and/or external additives of the toner used for developing are adhered to the surface of the photoreceptor 1, they tend to attract paper dust and thereby the filming problem is easily caused. By using an intermediate transfer medium, chance of occurrence of the filming problem can be dramatically reduced.

In the tandem image forming apparatus illustrated in FIG. 11, color toner images formed on the respective photoreceptors 1 are primarily transferred onto the intermediate transfer medium 20 to form a combined color toner image thereon. The combined color toner image is secondarily transferred onto the receiving material 9. Thus, the toner images are transferred onto the receiving material 9 while the photoreceptor 1 is not directly contacted with the receiving material. Therefore, the photoreceptor has a long life and the image forming apparatus can produce high quality images. It is necessary for tandem image forming apparatus that change with time in degree of deterioration among the four photoreceptors is reduced as much as possible. Specifically, when the four photoreceptors 1 illustrated in FIG. 11 have largely different properties (such as abrasion loss and contamination degree), the image qualities (such as color reproducibility and resolution) of the resultant full color toner images deteriorate. Particularly, when image omissions are formed, the color reproducibility of the image deteriorates. Deterioration of color reproducibility is fatal to full color images.

In a case of tandem full color image forming apparatus having no intermediate transfer medium, influence of paper dust on the contamination of the photoreceptor is remarkable among contaminants such as discharging-induced materials, eternal additives of toner and paper dust. This is because the photoreceptors have to be contacted with a paper sheet until color toner images thereon are transferred onto the paper sheet although such image forming apparatus typically have a mechanism such that when only a black image is formed, the photoreceptors other than the photoreceptor for forming the black toner image are separated from the paper sheet so as not to be contacted with the paper sheet. However, a need for printing a black image in such image forming apparatus is few. Therefore, influence of paper dust on the contamination of the photoreceptor is remarkable, and it is preferable to use an intermediate transfer medium for such tandem image forming apparatus. By using the photoreceptor mentioned above for such tandem image forming apparatus having an intermediate transfer medium, images having a good combination of color reproducibility and resolution can be produced over a long period of time (i.e., the photoreceptor has high durability) with hardly causing the filming problem and a blurred image problem in that blurred images are formed due to contamination of the surface of the photoreceptor.

In order to remove residual toner particles from the surface of the photoreceptor 1, a fur brush, a cleaning blade or a combination thereof is used for the cleaning device. In the image forming apparatus of the present invention, not only the residual toner particles on the surface of the photoreceptor but also discharging-induced materials adhered thereto have to be removed therefrom. Therefore, a cleaning blade is preferably used for the cleaning device. Since micro convexities are formed on the surface of the photoreceptor 1, the area of the surface of the photoreceptor contacted with the cleaning blade can be reduced, thereby preventing the surface of the photoreceptor from being excessively abraded while improving the cleanability of the photoreceptor. In addition, since discharging-induced materials are mainly present on the groove portions (i.e., "bottom" in FIG. 1) formed around the convexities, i.e., since the surface of the photoreceptor is separated into portions on which discharging-induced materials are present and other portions on which discharging-induced materials are hardly present, format ion of blurred images can be prevented. Thereby, high quality images can be stably produced over a long period of time.

In FIGS. 10 and 11, numeral 19 denotes a cleaning device configured to clean the surface of the photoreceptor 1.

In order to impart good slipping property to the surface of the photoreceptor 1, a material including a lubricating component can be applied to the surface of the photoreceptor. Applying such a lubricating material improves the releasability and abrasion resistance of the photoreceptor, and prevents adhesion of foreign materials such as toner particles and paper dust to the surface of the photoreceptor. Any known lubricity-imparting materials can be used as the lubricating material, and silicone compounds, fluorine-containing compounds, and compounds having a long alkyl group can be preferably used.

Suitable silicone compounds include any known compounds having a silicon atom in the molecule thereof. Specific examples thereof include silicone resins, particulate silicone resins, and silicone greases.

Suitable fluorine-containing compounds include any known compounds having a fluorine atom in the molecule thereof. Specific examples thereof include polytetrafluoroethylene (PTFE), perfluoroethylene/perfluoroalkoxyethylene copolymer (PFA), polyvinylidene fluoride (PVDF), and fluorine-containing greases.

Suitable compounds for use as the compounds having a long alkyl group include any known compounds having a long alkyl group in the molecule thereof. Among these compounds, zinc stearate is preferably used.

In addition, other lubricating materials such as polyolefin resins, paraffin waxes, fatty acid esters, graphite and molybdenum disulfide can also be used.

When a lubricating material is applied to the surface of a photoreceptor, the photoreceptor can maintain good releasability over a long period of time. However, it is difficult to control the weight of the applied lubricating material, and applying an excessive amount of lubricating material causes the filming problem and uneven abrasion of the surface of the photoreceptor, and produces abnormal images. In contrast, when such a lubricating material is applied to the surface of the photoreceptor mentioned above for use in the present, the material is mainly located in the groove portions of the surface. Therefore, a certain amount of lubricating material is present on the surface of the photoreceptor, resulting in maintenance of good lubricating property of the photoreceptor. Accordingly, the photoreceptor is prevented from being contaminated, resulting in prevention of occurrence of uneven abrasion and formation of abnormal images.

The method for applying such a lubricating material is not particularly limited. For example, a method in which a solid lubricating material is directly applied to the surface of the photoreceptor; a method in which a lubricating material is scraped with a brush and then the brush is contacted with the surface of the photoreceptor to transfer the lubricating material; and a method in which a lubricating material is included in the toner, can be used.

After the surface of the photoreceptor is cleaned, charges remaining on the surface of the photoreceptor are optionally removed by a discharging device 2. Suitable devices for use as the discharging device 2 include discharging lamps, and discharging chargers. The light sources mentioned above for use in the light irradiating device and the chargers mentioned above for use in the charging device 3 can be used as the discharging device 2.

In addition, the image forming apparatus includes a document reader configured to read the image of an original document, a receiving material feeding device configured to feed receiving material sheets one by one, a fixing device configured to fix the toner image on a receiving material sheet, and a discharging device configured to discharge a copy sheet bearing a fixed image thereon from the main body of the image forming apparatus. Known devices can be used for these devices.

The image forming process of the image forming apparatus of the present invention is not limited to the examples illustrated in FIGS. 8, 10 and 11. For example, light irradiation processes other than the light irradiation process, pre-cleaning light irradiation process and discharging process for decaying the residual charges on the photoreceptor can be performed. Specific examples thereof include a light irradiation process performed before the transfer process, and a pre-light irradiation process performed before the light irradiation process.

The above-mentioned image forming devices can be fixedly incorporated in an image forming apparatus such as copiers, facsimiles and printers, but the devices can be detachably attached to the image forming apparatus as a process cartridge.

Figure 12:
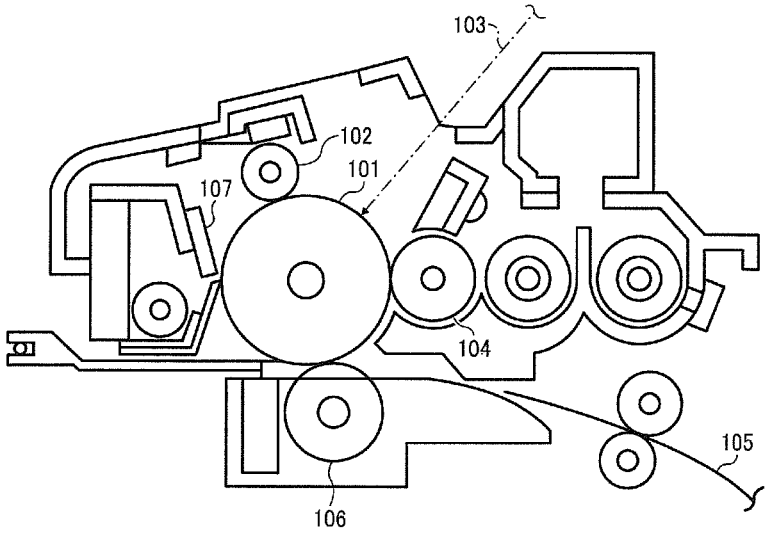
FIG. 12 is a schematic view illustrating a process cartridge of the present invention.

FIG. 12 illustrates an example of the process cartridge for use in electrophotographic image forming apparatus. The process cartridge includes at least the photoreceptor mentioned above and a cleaning device having a cleaning blade, and optionally includes one or more of charging devices, developing devices, transferring devices, and discharging devices, wherein the devices are unitized so that the process cartridge can be detachably attached to an image forming apparatus.

In the present invention, the process cartridge includes the photoreceptor mentioned above and a cleaning device for cleaning the surface of the photoreceptor. The process cartridge is detachably attached to an image forming apparatus such as tandem image forming apparatus (illustrated in FIG. 11), image forming apparatus in which the photoreceptor is not directly contacted with a paper sheet serving as a receiving material, and combinations of these image forming apparatus.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Formation of Undercoat Layer

The following components were mixed and dispersed to prepare an undercoat layer coating liquid.

| | |
|---|---|
| Alkyd resin (BEKKOSOL 1307-60-EL from Dainippon Ink And Chemicals, Inc.) | 6 parts |
| Melamine resin (SUPER BEKKAMINE G-821-60 from Dainippon Ink And Chemicals, Inc.) | 4 parts |
| Titanium oxide (CR-EL from Ishihara Sangyo Kaisha Ltd.) | 40 parts |
| Methyl ethyl ketone | 50 parts |

The undercoat layer coating liquid was applied on a surface of an aluminum drum having an outside diameter of 30 mm, a length of 340 mm and a thickness of 0.8 mm using a dip coating method, and the coated liquid was dried. Thus, an undercoat layer having a thickness of 3.5 μm was prepared. In this regard, the thickness of the undercoat layer was measured with an eddy current thickness meter, and the thickness data of randomly selected five points in the axis direction of the photoreceptor were averaged. The thickness measuring operation was performed before and after formation of the undercoat layer to determine the thickness of the undercoat layer.

(Formation of Charge Generation Layer)

The following components were mixed to prepare a charge generation layer coating liquid.

| | |
|---|---|
| Polyvinyl butyral resin (XYHL from Union Carbide Corporation) | 0.5 parts |
| Cyclohexanone | 200 parts |
| Methyl ethyl ketone | 80 parts |
| Bisazo pigment having the following formula | 2.5 parts |

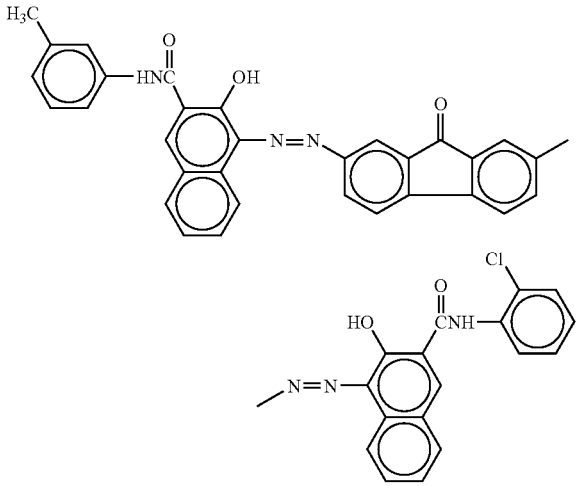

The charge generation layer coating liquid was applied on the undercoat layer by a dip coating method, and the coated liquid was heated to be dried. Thus, a charge generation layer having a thickness of 0.2 μm was prepared.

(Formation of Charge Transport Layer)

The following components were mixed to prepare a charge transport layer coating liquid.

| | |
|---|---|
| Bisphenol Z-form polycarbonate | 10 parts |
| Low-molecular-weight charge transport material having the following formula | 10 parts |

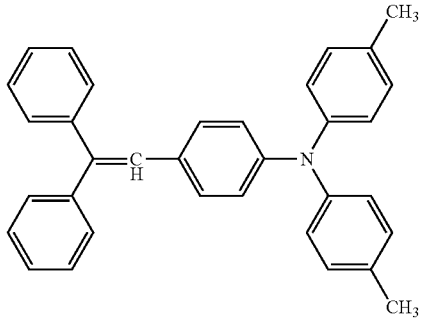

| | |
|---|---|
| Tetrahydrofuran | 80 parts |
| 1% tetrahydrofuran solution of silicone oil (Silicone oil: KF50-100CS from Shin-Etsu Chemical Co., Ltd.) | 0.2 parts |

The charge transport layer coating liquid was applied on the charge generation layer by a dip coating method, and the coated liquid was heated to be dried. Thus, a charge transport layer having a thickness of 22 μm was prepared.

(Formation of Crosslinked Outermost Layer)

The following components were mixed to prepare an outermost layer coating liquid.

| | |
|---|---|
| Trimethylolpropanetriacrylate (KAYARADTMPTA from Nippon Kayaku Co., Ltd., which includes three functional groups, and has a molecular weight of 382 and a ratio (MW/F) of molecular weight (MW) to the number (F) of functional groups of 99 (i.e., 382/3) and which serves as a tri- or more-functional radically polymerizable monomer having no charge transport structure) | 9 parts |
| Radical polymerizable compound having the following charge transportable structure | 9 parts |

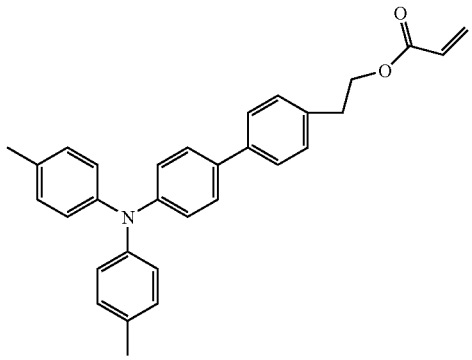

| | |
|---|---|
| 2-[4'-(di-p-tolyl-amino)biphenyl-4-yl]ethyl acrylate | |
| Mixture of polyester-modified polydimethylsiloxane and propoxy-modified 2-neopentylglycoldiacrylate (BYK-UV3570 from BYK-Chemie GmbH) | 0.01 parts |

The outermost layer coating liquid was applied on the surface of the charge transport layer using a spray gun from Olympos. The coating conditions were as follows.

Pressure: 1.5 kgf/mm$^2$

Discharge rate of the coating liquid: 8 g/min

Coating time: 60 seconds

Revolution of rotated (photoreceptor) drum: 40 rpm

Oscillating speed: 2.7 mm/sec

After the coating liquid was applied on the charge transport layer, the coated liquid was exposed to UV rays emitted by a metal halide lamp, which was set at a location 120 mm apart from the surface of the (photoreceptor) drum, while the aluminum drum was rotated at a revolution of 25 rpm so that the outermost layer was crosslinked. In this regard, the illuminance of the outermost layer was 600 mW/cm$^2$ when measured with an ultraviolet integrating actinometer (UIT-150 from Ushio, Inc.). In addition, the UV crosslinking operation was performed for 4 minutes while circulating water of 30'C in the aluminum drum. Further, the outermost layer was heated for 30 minutes at 130° C. to form a crosslinked outermost layer having a thickness of about 4.0 μm on the charge transport layer. Thus, an electrophotographic photoreceptor having a crosslinked outermost layer including a crosslinked body of a charge transportable compound was prepared.

(Formation of Convexities)

The above-prepared outermost layer coating liquid was coated on the outermost layer using the spray gun by the same above-mentioned coating conditions. The thus coated convexities were also subjected to the UV crosslinking treatment to prepare the electrophotographic photoreceptor of the present invention. The surface thereof was observed by an optical microscope to find many convexities were formed thereon.

Figure 13A:
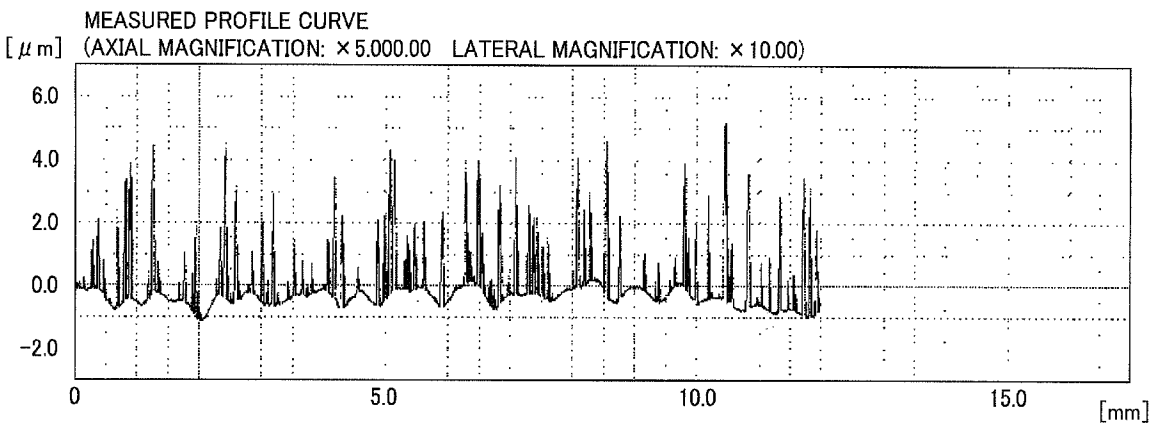
FIG. 13 is a profile curve of the surface of the photoreceptor in Example 1, measured by a roughness meter.
Figure 13B:
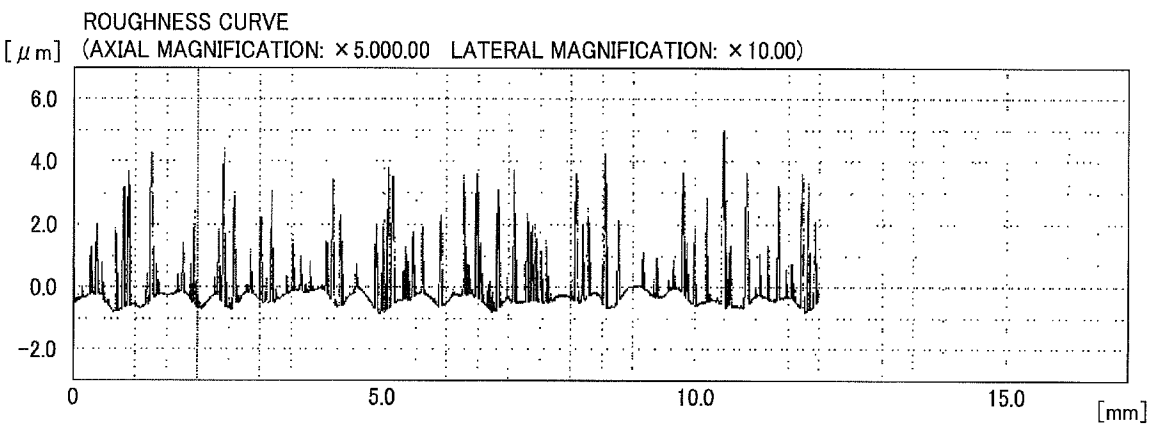

The profile of the surface of the thus prepared photoreceptor was obtained using a surface roughness tester (SURFCOM 1400D from Tokyo Seimitsu Co., Ltd.) with a measuring head DT43801. The profile curve and the roughness curve of the surface of the photoreceptor are shown in FIGS. 13A and 13B, respectively. In the figures, the vertical magnification and the horizontal magnification are 5,000 and 10, respectively, and the measuring length is 12 mm. Two central parts of the image forming area of the cylindrical photoreceptor and two middle positions between the central parts and the edge were measured. The profile curve illustrated in FIG. 13A includes waviness components. The roughness curve illustrated in FIG. 13B is obtained by removing waviness components.

The waviness components are removed from the profile curve with a frequency filter (cutoff: R2C) to determine the roughness curve, from which RzJIS is determined (JIS B0601: '01). The average of RzJIS of the 4 parts was 4.1535 μm.

The profile curve illustrated in FIG. 13A has a shape like a comb. This is because the outermost layer coating liquid was sprayed on the outermost layer. Many independent convexities extending in the vertical direction (i.e., Z-direction) were found to be randomly present on the surface of the photoreceptor. Since the vertical magnification is different from the horizontal magnification in the profile curve illustrated in FIG. 13A, the convexities seem to have a shape like a spike, but in reality the convexities have a gentle slope.

Next, the number of the convexities was counted by the method mentioned above. Specifically, at first the ground portion of the convexities (i.e., the deepest valley) was determined in the profile curve. Next, on the basis of the thus determined ground, the height of each of the peaks was determined, and the number of the peaks having a height of not less than Rz/2 (i.e., 2.077 μm) present in a measurement range of from 0 to 12 mm was counted. As a result, the number of the convexities was 62. In this regard, shoulders and sub-peaks of main peaks were disregarded. The average height of the 62 convexities was determined to be 3.326 μm. The measurement conditions were as follows.

Measurement method: JIS B0610 (2001)

Measurement length: 12 mm

Cut off wavelength: 0.8 mm

Measurement magnification: ×20K

Measurement speed: 0.06 mm/sec

Cut off: R2C (phase compensation)

Slope correction: The least squares method was used.

Figure 14:
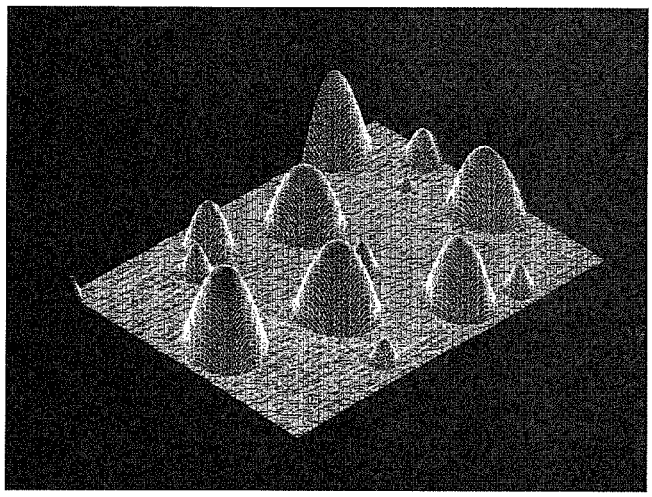
FIG. 14 is a 3D image of the surface of the photoreceptor in Example 1, observed by a laser microscope.

The surface of the photoreceptor observed with a laser microscope (VP-8500 from Keyence Corporation) using an objective lens of 100 power magnification is illustrated in FIG. 14. In FIG. 14, the ratio of the vertical magnification to the horizontal magnification is 50/1. It is clear from FIG. 11 that many independent convexities having a smooth base are formed.

Comparative Example 1

The procedure for preparation of the photoreceptor in Example 1 was repeated except that the spray coating for forming the convexities was not performed.

Figure 15:
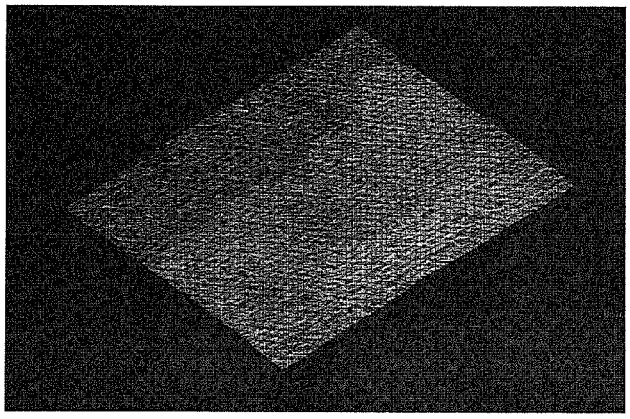
FIG. 15 is a 3D image of the surface of the photoreceptor in Comparative Example 1, observed by a laser microscope.

The surface of the photoreceptor observed with the laser microscope is illustrated in FIG. 15. It was clear from FIG. 15 that the surface was flat and no convexity was present.

Examples 2 to 7 and Comparative Example 2

The procedure for preparation of the photoreceptor in Example 1 was repeated except for changing the spray coating conditions as shown in Table 1. The results are shown in Tables 2-1 to 2-4.

TABLE 1

| | Oscillating speed (mm/s) | Drum rotation number (rpm) | Aperture (scale) | Atomization Pressure (kgf/mm$^2$) |
|---|---|---|---|---|
| Condition 1 | 5 | 100 | 8 | 2 |
| Condition 2 | 5 | 200 | 12 | 3 |
| Condition 3 | 5 | 300 | 4 | 1 |
| Condition 4 | 10 | 200 | 4 | 2 |
| Condition 5 | 10 | 300 | 8 | 3 |
| Condition 6 | 15 | 100 | 4 | 3 |
| Condition 7 | 15 | 200 | 8 | 1 |
| Condition 8 | 15 | 300 | 12 | 2 |

TABLE 2-1

| | | Rz(μm) Number of Measurement | | | | |
|---|---|---|---|---|---|---|
| | | 1 | 2 | 3 | 4 | Average |
| Example 2 | Condition 1 | 6.2 | 6.1 | 5.8 | 6.6 | 6.2 |
| Reference Example | Condition 2 | 0.2 | 0.2 | 0.2 | 0.2 | 0.2 |
| Example 3 | Condition 3 | 2.5 | 2.5 | 2.6 | 2.8 | 2.6 |
| Example 4 | Condition 4 | 3.2 | 3.5 | 3.6 | 3.5 | 3.5 |
| Example 5 | Condition 5 | 4.9 | 5.0 | 4.9 | 4.7 | 4.8 |
| Comparative Example 2 | Condition 6 | 1.9 | 1.7 | 1.6 | 1.6 | 1.7 |
| Example 6 | Condition 7 | 4.0 | 4.1 | 4.0 | 4.6 | 4.2 |
| Example 7 | Condition 8 | 6.3 | 6.2 | 6.2 | 5.9 | 6.2 |

TABLE 2-2

| | | ½Rz(μm) Number of Measurement | | | | |
|---|---|---|---|---|---|---|
| | | 1 | 2 | 3 | 4 | Average |
| Example 2 | Condition 1 | 3.1 | 3.1 | 2.9 | 3.3 | 3.1 |
| Reference Example | Condition 2 | 0.1 | 0.1 | 0.1 | 0.1 | 0.1 |
| Example 3 | Condition 3 | 1.3 | 1.2 | 1.3 | 1.4 | 1.3 |
| Example 4 | Condition 4 | 1.6 | 1.8 | 1.8 | 1.8 | 1.7 |
| Example 5 | Condition 5 | 2.4 | 2.5 | 2.4 | 2.3 | 2.4 |
| Comparative Example 2 | Condition 6 | 0.9 | 0.9 | 0.8 | 0.8 | 0.8 |
| Example 6 | Condition 7 | 2.0 | 2.1 | 2.0 | 2.3 | 2.1 |
| Example 7 | Condition 8 | 3.2 | 3.1 | 3.1 | 2.9 | 3.1 |

TABLE 2-3

| | | Number of convexities (/12 mm) Number of Measurement | | | | |
|---|---|---|---|---|---|---|
| | | 1 | 2 | 3 | 4 | Average |
| Example 2 | Condition 1 | 59 | 59 | 45 | 55 | 55 |
| Reference Example | Condition 2 | * | * | * | * | * |
| Example 3 | Condition 3 | 58 | 551 | 35 | 49 | 48 |
| Example 4 | Condition 4 | 79 | 68 | 70 | 59 | 69 |
| Example 5 | Condition 5 | 75 | 75 | 77 | 86 | 78 |
| Comparative Example 2 | Condition 6 | 335 | 368 | 289 | 273 | 316 |
| Example 6 | Condition 7 | 62 | 50 | 48 | 54 | 54 |
| Example 7 | Condition 8 | 55 | 61 | 53 | 57 | 57 |

* The profile curve is gentle

TABLE 2-4

| | | Height of convexities (μm) Number of Measurement | | | | |
|---|---|---|---|---|---|---|
| | | 1 | 2 | 3 | 4 | Average |
| Example 2 | Condition 1 | 6.36 | 5.46 | 4.95 | — | 5.59 |
| Reference Example | Condition 2 | * | * | * | * | * |
| Example 3 | Condition 3 | 1.97 | 1.83 | 2.05 | 2.16 | 2.00 |
| Example 4 | Condition 4 | 2.47 | 2.68 | 2.70 | 2.57 | 2.60 |
| Example 5 | Condition 5 | 3.14 | 4.09 | 3.89 | 3.68 | 3.70 |
| Comparative Example 2 | Condition 6 | 1.24 | 1.15 | 1.03 | 1.02 | 1.11 |
| Example 6 | Condition 7 | 3.33 | 3.39 | 3.16 | 3.77 | 3.41 |
| Example 7 | Condition 8 | 5.22 | 5.25 | 5.28 | 5.52 | 5.32 |

The condition 2 had no convexity and had only waves. The condition 4 had too large convexities having a diameter of from 1 to 3 mm when observed by an optical microscope. Except these, 48 to 316 crosslinked convexities having an average height of from 1 to about 6 μm and not less than Rz/2 were formed on the surface in the measurement length of 12 mm. The condition 2 was excluded in the evaluation mentioned later.

Example 8

The procedure for preparation of the photoreceptor in Example 6 was repeated except for changing the atomization pressure into 2 kgf/mm$^2$. The evaluation results are shown in Table 3.

Example 9

The procedure for preparation of the photoreceptor in Comparative Example 2 was repeated except for changing the aperture from 4 into 2. The evaluation results are shown in Table 3.

Example 10

The procedure for preparation of the photoreceptor in Example 2 was repeated except for changing the aperture from 8 into 10. The evaluation results are shown in Table 3.

Comparative Example 3

The procedure for preparation of the photoreceptor in Example 6 was repeated except for changing the atomization pressure into 0.8 kgf/mm$^2$. The evaluation results are shown in Table 3.

Comparative Example 4

A photoreceptor having well-form convexities and recesses was prepared by the method described in the above-mentioned Japanese published unexamined application No. 2001-66814. Specifically, an aluminum cylinder was subjected to horning so as to have a rough surface having a roughness Ra (i.e., Arithmetical Mean Deviation of the Profile) of 0.18 μm.

(Formation of Undercoat Layer)

The following undercoat layer coating liquid was prepared and applied on the rough surface of the aluminum cylinder by a dip coating method, followed by drying to form an undercoat layer with a thickness of 1.2 μm.

| | |
|---|---|
| Polyvinyl butyral (S-LEC BM-S from Sekisui Chemical Co., Ltd.) | 4 parts |
| Acetylacetone zirconium butyrate | 30 parts |
| γ-aminopropyltrimethoxy silane | 3 parts |

(Formation of Charge Generation Layer)

The following components were mixed and the mixture was subjected to a dispersing treatment for 4 hours using a sand mill to prepare a charge generation layer coating liquid.

| | |
|---|---|
| Chloro gallium phthalocyanine (serving as a charge generation material and having an X-ray diffraction spectrum such that peaks are observed at Bragg 2θ angles of 7.4°, 16.6°, 25.5° and 28.3° when CuKα is used) | 3 parts |
| Vinyl chloride - vinyl acetate copolymer (VMCH from Nippon Unicar Company Limited) | 2 parts |
| Butyl acetate | 180 parts |

The thus prepared charge generation layer coating liquid was applied on the undercoat layer by a dip coating method, followed by drying to form a charge generation layer with a thickness of 0.2 μm.

(Formation of Charge Transport Layer)

The following components were mixed to prepare a solution.

| | |
|---|---|
| N,N'-diphenyl-N,N-bis(3-methylphenyl)-[1,1'-bisphenyl]-4,4'-diamine | 4 parts |
| Polycarbonate resin (IUPILON Z400 from Mitsubishi Chemical Corporation) | 6 parts |
| Tetrahydrofuran | 60 parts |
| 2,6-di-t-butyl-4-methylphenol | 0.2 parts |

Further, 3 parts of a particulate silica (TOSPEARL 102 from Toshiba Silicone Co., Ltd. having a volume average particle diameter of 500 nm) was added to the solution, and then the mixture was subjected to a dispersing treatment to prepare a charge transport layer coating liquid.

The thus prepared charge transport layer coating liquid was applied on the charge generation layer by a dip coating method, followed by drying to form a charge transport layer with a thickness of 25 μm.

(Formation of Convexities)

According to the method described in Japanese published unexamined application No. 2001-66814, a die equipped with a stamper having plural convexities was pressed to the surface of the charge transport layer to form (transfer) convexities on the surface of the charge transport layer.

As a result, well-form recessed portions, each of which has a diameter of 0.7 μm and an average depth of 0.5 μm and which are arranged at a pitch of 1.1 μm, were formed on the surface of the charge transport layer.

Comparative Example 5

The photoreceptor of Example 1 was subjected to blast finishing using glass beads. Specifically, a mixture of glass beads and air was sprayed to collide against the surface of the photoreceptor, which was horizontally set while rotated, thereby roughening the surface of the photoreceptor. The blast finishing conditions were as follows.

Diameter of glass beads: 50 μm

Spraying pressure: 2.5 kgf/cm

Moving speed of spray gun: 460 mm/min

Figure 16A:
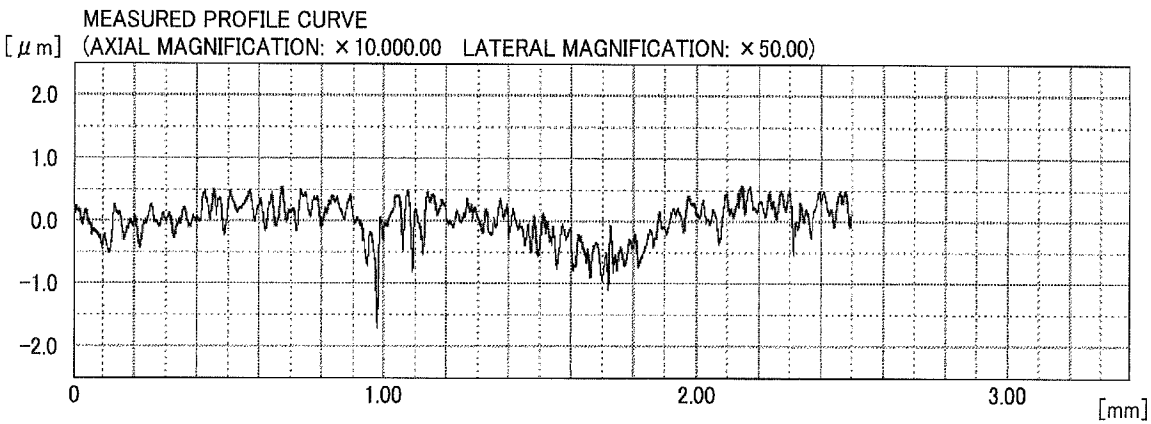
FIG. 16 is a profile curve of the surface of the photoreceptor in Comparative Example 5, measured by a roughness meter.
Figure 16B:
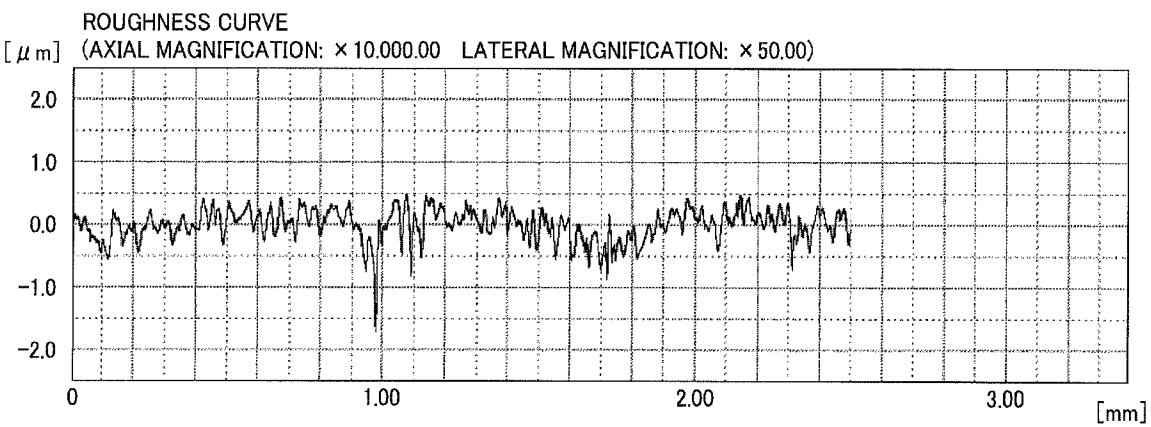

The profile curve and roughness curve of the photoreceptor are illustrated in FIGS. 16A and 16B, respectively. It is clear from FIGS. 16A and 16B that convexities like teeth of a comb are not formed unlike the surface of the photoreceptor of Example 1. It was determined from the roughness curve that the ten-point mean roughness Rz is 1.479 μm. In addition, the surface has deep flaws and microscopic cracks (i.e., deep recessed portions) which are considered to be caused by collision of glass beads. Therefore, the photoreceptor was not evaluated.

Each photoreceptor of Examples 1 to 10 and Comparative Examples 1 to 4 was set in a process cartridge, and the cartridge was set in a modified copier imagio MF4500 from Ricoh Co., Ltd., which uses a laser diode emitting a laser beam having a wavelength of 655 nm as the light source of the light irradiating device, a charging roller, and a cleaning blade, and a running test in which 50,000 copies of an original image are continuously produced was performed. The cleaning blade made of polyurethane was contacted to the photoreceptor in the counter direction at a pressure of 30 g/cm and an angle of 30°. The image forming conditions were as follows.

Toner used: polymerization toner having a volume average particle diameter of 6 μm Environmental conditions: 25° C. 65% RH Potential (Vd) of dark portion of photoreceptor: −800V Potential (Vl) of irradiated portion of photoreceptor: −200V Receiving material: TYPE 6200 paper from Ricoh Co., Ltd. (A4 size)

Original Image: Test Chart Having Photographic Images and character images (for use in evaluating black solid image, half tone image and background)

The evaluation of the photoreceptor was performed as follows.

The image qualities of the tenth to twentieth copies at the beginning of the running test, and first to tenth images produced after the running test were compared to determine whether the image qualities deteriorate.

In addition, the tip of the cleaning blade was observed with a microscope after the running test. The evaluation items are as follows.

(1) Passing of Toner Through Gap Between Blade and Photoreceptor (i.e., Toner Blocking Property)

The images produced after the running test were observed to determine whether a streak image caused by passing of the toner through the gap between the blade and the photoreceptor is present in the images. The images were graded as follows.

Grade A: The images have no streak image. (Excellent)

Grade B: The images have a slight streak image.

Grade C: The images have a clear streak image.

Grade D: The images have two or more clear streak images. (Bad)

(2) Fixation of Toner on Photoreceptor (i.e., Toner Fixation Resistance)

The surface of the photoreceptor was observed to determine whether the toner is fixed on the photoreceptor. In addition, the images produced after the running test were observed to determine whether abnormal images caused by a fixed toner are produced. The images were graded as follows.

Grade A: The toner is not fixed on the surface of the photoreceptor, and no abnormal image is produced. (Excellent)

Grade B: The toner is slightly fixed on a small portion of the surface of the photoreceptor, and a minor abnormal image is produced in a small portion of the image.

Grade C: The toner is fixed on a portion of the surface of the photoreceptor, and an abnormal image is produced in a portion of the image.

Grade D: The toner is fixed on the entire portion of the surface of the photoreceptor, and an abnormal image is produced in the entire portion of the image. (Bad)

TABLE 3-1

| | Photoreceptor Properties | | | | |
|---|---|---|---|---|---|
| | Rz μm | Rz/2 μm | Thickness of outermost layer μm | Number of convexities/12 mm Pieces | Height of convexities/12 mm μm |
| Example 1 | 4.15 | 2.08 | 4.0 | 62 | 3.33 |
| Example 2 | 6.20 | 3.10 | 4.0 | 55 | 5.59 |
| Example 3 | 2.60 | 1.30 | 4.2 | 48 | 2.00 |
| Example 4 | 3.50 | 1.70 | 4.0 | 69 | 2.60 |
| Example 5 | 4.80 | 2.40 | 4.2 | 68 | 3.70 |
| Example 6 | 4.20 | 2.10 | 5.0 | 54 | 3.41 |
| Example 7 | 6.20 | 3.10 | 5.1 | 57 | 5.32 |
| Example 8 | 4.92 | 2.45 | 4.1 | 33 | 3.14 |
| Example 9 | 1.90 | 0.95 | 3.8 | 100 | 0.05 |
| Example 10 | 2.50 | 1.25 | 4.1 | 52 | 6.20 |
| Comparative Example 1 | 0.02 | 0.02 | 4.0 | * | * |
| Comparative Example 2 | 1.70 | 0.80 | 4.1 | 316 | 1.11 |

TABLE 3-1-continued

| | Photoreceptor Properties | | | | |
|---|---|---|---|---|---|
| | Rz μm | Rz/2 μm | Thickness of outermost layer μm | Number of convex-ities/12 mm Pieces | Height of convex-ities/12 mm μm |
| Comparative Example 3 | 4.80 | 2.40 | 4.0 | 28 | 3.00 |
| Comparative Example 4 | ** | ** | 5.8 | ** | ** |

TABLE 3-2

| | Photoreceptor Durability | | | | | | |
|---|---|---|---|---|---|---|---|
| | Initial | | After 50,000 | | | | Overall |
| | (1) | (2) | (1) | (2) | Blade | Image | evaluation |
| Example 1 | A | A | A | A | Good | Good | A |
| Example 2 | A | A | A | A | Good | Good | A |
| Example 3 | A | A | A | A | Good | Good | A |
| Example 4 | A | A | A | A | Good | Good | A |
| Example 5 | A | A | A | A | Good | Good | A |
| Example 6 | A | A | A | A | Good | Good | A |
| Example 7 | A | A | A | A | Good | Good | A |
| Example 8 | A | A | A | A | Good | Good | A |
| Example 9 | B | B | B | B | Good | Good | B |
| Example 10 | B | B | B | B | Good | Slight stripe due to toner passing (recovered) | B |
| Comparative Example 1 | C | B | D | D | Vibrated, twisted and reversed | Black stripe image after 6,000 | D |
| Comparative Example 2 | B | B | C | C | Good | Stripe due to toner passing | C |
| Comparative Example 3 | B | B | C | C | Good | Stripe due to toner passing | C |
| Comparative Example 4 | B | B | D | D | Good | Black stripe Image after 50,000 | D |

The following is clearly understood from Tables 3-1 and 3-2.

(1) By forming specific convexities on the surface of a photoreceptor, vibration, reversing and twisting of a cleaning blade can be avoided.

(2) When the convexities have a height of greater than 6 μm, there is a case where the photoreceptor produces images having a minor defect (such as streak images caused by toner passing). However, after repeating image formation, the defect disappeared.

(3) When the number of the convexities is less than 30 or greater than 100 in the range of 12 mm, abnormal images are formed.

(4) In all Examples, no local chipped contact point of the blade to the photoreceptor was observed by a microscope.

(5) Comparative Example 4 produced Black stripe image due to toner passing after 50,000 images were produced.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Application No. 2009-000622, filed on Jan. 6, 2009, the entire contents of which are herein incorporated by reference.

What is claimed is:

1. An electrophotographic photoreceptor, comprising:

an electroconductive substrate;

a photosensitive layer, located overlying the electroconductive substrate; and an outermost layer including a plurality of convexities that are located overlying the photosensitive layer and are independent each other, wherein each of the outermost layer and the convexities includes a crosslinked body including a structural unit having a triarylamine structure, wherein the crosslinked body is formed by crosslinking a coating liquid comprising a compound having the following formula (1):

(1)

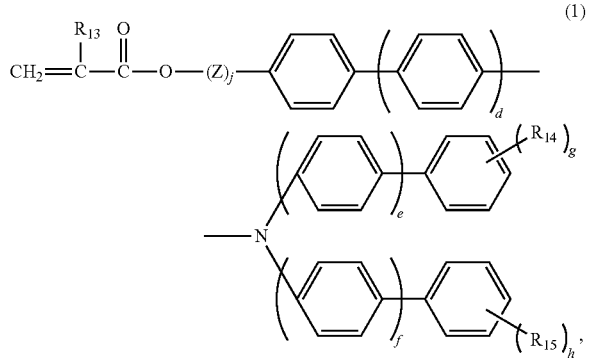

and wherein each of d, e and f is 0 or 1; each of g and h is 0 or an integer of from 1 to 3; $R_{13}$ represents a hydrogen atom or a methyl group; each of $R_{14}$ and $R_{15}$ represents an alkyl group having from 1 to 6 carbon atoms, wherein when g is 2 or 3, the groups $R_{14}$ may be the same as or different from each other, and when h is 2 or 3, the groups $R_{15}$ may be the same as or different from each other; Z represents a methylene group, an ethylene group or one of the following groups:

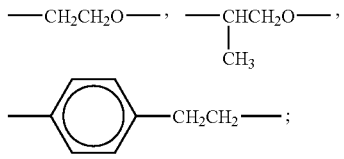

and j is 0 or 1; and wherein the number of the convexities having a height not less than ½×RzJIS is from 30 to 300 in a measurement length of 12 mm, wherein RzJIS is an average of ten-point mean roughness and measured at least 4 random positions in an area the outermost layer is formed on, and wherein for each specific convexity of the convexities, the height of the specific convexity is a distance from the deepest valley to a top of the convexity in the measurement length of 12 mm wherein the height of the convexity is greater than 1.5 μm and no more than 6 μm.

2. The electrophotographic photoreceptor of claim 1, wherein the convexity is formed by a spray coating method.

3. An image forming apparatus, comprising:

an electrophotographic photoreceptor;

a charging device configured to charge the electrophotographic photoreceptor;

an irradiating device configured to irradiate the electrophotographic photoreceptor to form an electrostatic latent image thereon;

a developing device configured to develop the electrostatic latent image with a toner to form a toner image on the electrophotographic photoreceptor; and a transferring device configured to transfer the toner image onto a receiving material, wherein the electrophotographic photoreceptor is the electrophotographic photoreceptor according to claim 1.

4. The image forming apparatus of claim 3, wherein the toner is a toner prepared by a polymerization method.

5. The image forming apparatus of claim 3, further comprising at least two tandem developing stations each comprising the electrophotographic photoreceptor, the charging device, the irradiating device, the developing device and the transferring device.

6. The image forming apparatus of claim 3, further comprising a process cartridge detachable from the image forming apparatus, comprising:

an electrophotographic photoreceptor;

a developing device; and a cleaning device.

7. A process cartridge detachable from image forming apparatus, comprising:

an electrophotographic photoreceptor;

a developing device; and a cleaning device, wherein the electrophotographic photoreceptor is the electrophotographic photoreceptor according to claim 1.

* * * * *